US012036440B2

(12) United States Patent
Bentivoglio et al.

(10) Patent No.: US 12,036,440 B2
(45) **Date of Patent: *Jul. 16, 2024**

(54) PILATES REFORMER

(71) Applicant: Frame Innovative Technologies Corp., Miami Beach, FL (US)

(72) Inventors: Melissa Bentivoglio, Miami Beach, FL (US); Lee Belzberg, Miami Beach, FL (US)

(73) Assignee: FRAME INNOVATIVE TECHNOLOGIES CORP., Boynton Beach, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/107,576

(22) Filed: Feb. 9, 2023

(65) Prior Publication Data

US 2023/0181968 A1 Jun. 15, 2023

Related U.S. Application Data

(63) Continuation of application No. 17/719,874, filed on Apr. 13, 2022, now Pat. No. 11,607,582.

(60) Provisional application No. 63/233,011, filed on Aug. 13, 2021, provisional application No. 63/197,004, filed on Jun. 4, 2021.

(51) Int. Cl.

| | |
|---|---|
| ***A63B 22/00*** | (2006.01) |
| ***A63B 21/00*** | (2006.01) |
| ***A63B 71/06*** | (2006.01) |

(52) U.S. Cl.

CPC .... *A63B 22/0089* (2013.01); *A63B 21/00065* (2013.01); *A63B 71/0622* (2013.01); *A63B 2210/50* (2013.01); *A63B 2225/09* (2013.01)

(58) Field of Classification Search

CPC ..... A63B 21/00065; A63B 22/0089; A63B 71/0622; A63B 2210/50; A63B 2225/09

See application file for complete search history.

(56) References Cited

U.S. PATENT DOCUMENTS

| | | | | |
|---|---|---|---|---|
| 2,733,922 | A * | 2/1956 | Giego | A63B 23/085 482/145 |
| 5,295,935 | A | 3/1994 | Wang | |
| 5,312,315 | A | 5/1994 | Mortensen et al. | |
| 5,620,403 | A | 4/1997 | Lundin | |

(Continued)

FOREIGN PATENT DOCUMENTS

| | | |
|---|---|---|
| CN | 2601700 | 1/2003 |
| KR | 10-2015-0103846 A | 9/2015 |

(Continued)

OTHER PUBLICATIONS

U.S. Appl. No. 29/800,109, filed Jul. 19, 2021, Bentivoglio et al.

(Continued)

*Primary Examiner* — Joshua Lee
(74) *Attorney, Agent, or Firm* — Crowell & Moring LLP

(57) ABSTRACT

A reformer may include a frame extending between a first end portion and a second end portion. The reformer may also include a carriage slidably coupled to the frame, where the carriage is movable along a length of the frame. The carriage is configured to be selectively and releasably coupled to the first end portion of the frame, and selectively and releasably coupled to the second end portion of the frame.

20 Claims, 19 Drawing Sheets

(56) References Cited

U.S. PATENT DOCUMENTS

| | | | | |
|---|---|---|---|---|
| 6,045,491 | A | 4/2000 | McNergney et al. | |
| 6,589,142 | B2 | 7/2003 | McAfee, Jr. | |
| 6,926,650 | B2 * | 8/2005 | Endelman | A63B 21/05 482/121 |
| 7,104,937 | B2 * | 9/2006 | Arbuckle | A63B 23/0405 482/142 |
| 7,134,987 | B2 | 11/2006 | Goldstein | |
| 7,803,095 | B1 | 9/2010 | LaGree | |
| 7,833,136 | B2 | 11/2010 | Bell | |
| 7,857,736 | B2 | 12/2010 | Merrithew et al. | |
| 7,901,338 | B2 | 3/2011 | Gerschefske | |
| 7,931,570 | B2 * | 4/2011 | Hoffman | A63B 23/03533 482/129 |
| 7,946,961 | B2 | 5/2011 | Blum et al. | |
| 8,113,997 | B2 | 2/2012 | Fernandez et al. | |
| 8,152,696 | B2 | 4/2012 | Blum et al. | |
| 8,192,338 | B2 * | 6/2012 | Solow | A63B 22/0087 482/142 |
| 8,249,714 | B1 | 8/2012 | Hartman et al. | |
| 8,323,157 | B2 * | 12/2012 | Campanaro | A63B 21/068 482/142 |
| 8,585,554 | B2 * | 11/2013 | Shavit | A63B 21/0557 482/121 |
| 8,641,585 | B2 | 2/2014 | LaGree | |
| 8,684,888 | B2 | 4/2014 | Blum et al. | |
| 9,011,293 | B2 | 4/2015 | Shavit et al. | |
| 9,072,931 | B2 | 7/2015 | Lagree | |
| 9,108,079 | B2 * | 8/2015 | Solow | A63B 22/0089 |
| 9,119,989 | B1 | 9/2015 | Lagree et al. | |
| 9,283,422 | B2 | 3/2016 | Lagree | |
| 9,302,152 | B2 | 4/2016 | Blum et al. | |
| 9,393,454 | B2 | 7/2016 | Lagree et al. | |
| 9,415,253 | B2 | 8/2016 | Lagree et al. | |
| 9,474,924 | B2 | 10/2016 | Lagree et al. | |
| 9,474,927 | B2 | 10/2016 | Lagree | |
| 9,498,667 | B1 | 11/2016 | Lagree et al. | |
| 9,522,299 | B2 | 12/2016 | Lagree | |
| 9,555,282 | B1 | 1/2017 | Lagree | |
| 9,579,536 | B1 | 2/2017 | Lagree | |
| 9,586,081 | B2 | 3/2017 | Lagree et al. | |
| 9,604,095 | B1 | 3/2017 | Lagree et al. | |
| 9,649,527 | B1 | 5/2017 | Lagree et al. | |
| 9,717,945 | B2 | 8/2017 | Lagree | |
| 9,744,395 | B1 | 8/2017 | Lagree et al. | |
| 9,868,010 | B2 | 1/2018 | Lagree et al. | |
| 9,868,018 | B2 | 1/2018 | Lagree | |
| 9,981,156 | B2 | 5/2018 | Lagree | |
| 9,987,520 | B2 | 6/2018 | Shavit et al. | |
| 10,022,577 | B2 | 7/2018 | Lagree et al. | |
| 10,029,141 | B2 | 7/2018 | Lagree | |
| 10,052,518 | B2 | 8/2018 | Lagree | |
| 10,109,216 | B2 | 10/2018 | Lagree | |
| 10,118,067 | B2 | 11/2018 | Lagree et al. | |
| 10,143,882 | B2 | 12/2018 | Lagree | |
| 10,155,129 | B2 | 12/2018 | Lagree et al. | |
| 10,213,641 | B2 | 2/2019 | Lagree | |
| 10,220,244 | B2 | 3/2019 | Lagree | |
| 10,272,285 | B2 | 4/2019 | Lagree et al. | |
| 10,449,410 | B2 | 10/2019 | Hamilton | |
| 10,675,497 | B2 | 6/2020 | Jaquish et al. | |
| 10,702,760 | B2 | 7/2020 | Lagree et al. | |
| 10,716,964 | B1 | 7/2020 | Lagree et al. | |
| 10,716,969 | B2 | 7/2020 | Hoang | |
| 10,744,370 | B1 | 8/2020 | Lagree | |
| 10,751,600 | B2 | 8/2020 | Lagree et al. | |
| 10,792,528 | B1 | 10/2020 | Lagree et al. | |
| 10,850,155 | B2 | 12/2020 | Lagree | |
| 10,850,161 | B2 * | 12/2020 | Shavit | A63B 23/03541 |
| 10,870,034 | B2 | 12/2020 | Lagree et al. | |
| 10,953,282 | B2 | 3/2021 | Villency et al. | |
| 10,957,218 | B1 | 3/2021 | Lagree | |
| 10,974,092 | B2 | 4/2021 | Lagree et al. | |
| 10,994,168 | B2 * | 5/2021 | Lagree | A63B 21/0056 |
| 11,058,913 | B2 * | 7/2021 | Dalebout | A63B 22/001 |
| 11,389,685 | B2 * | 7/2022 | Lagree | A63B 21/4033 |
| 11,446,549 | B2 * | 9/2022 | Maugeri | A63B 21/023 |
| 2003/0216230 | A1 | 11/2003 | Wang et al. | |
| 2004/0176227 | A1 | 9/2004 | Endelman | |
| 2006/0046914 | A1 | 3/2006 | Endelman et al. | |
| 2012/0190503 | A1 * | 7/2012 | Shavit | A63B 24/0062 482/5 |
| 2012/0258843 | A1 | 10/2012 | Summers | |
| 2016/0220860 | A1 | 8/2016 | Solow et al. | |
| 2018/0021621 | A1 * | 1/2018 | Lagree | A63B 21/0552 482/129 |
| 2018/0169464 | A1 | 6/2018 | Janowski | |
| 2019/0091515 | A1 | 3/2019 | Shavit et al. | |
| 2019/0358484 | A1 | 11/2019 | Lagree et al. | |
| 2020/0047027 | A1 | 2/2020 | Ward et al. | |
| 2020/0047030 | A1 | 2/2020 | Ward et al. | |
| 2020/0047053 | A1 | 2/2020 | Ward et al. | |
| 2020/0047054 | A1 | 2/2020 | Ward et al. | |
| 2020/0047055 | A1 | 2/2020 | Ward et al. | |
| 2020/0054929 | A1 | 2/2020 | Ward et al. | |
| 2020/0188720 | A1 | 6/2020 | Villency et al. | |
| 2020/0254294 | A1 | 8/2020 | Jaquish et al. | |
| 2020/0353312 | A1 | 11/2020 | Smith | |
| 2021/0069542 | A1 | 3/2021 | Lagree | |
| 2021/0101048 | A1 | 4/2021 | Lagree et al. | |
| 2022/0072378 | A1 * | 3/2022 | Alpay | A63B 21/154 |

FOREIGN PATENT DOCUMENTS

| | | | |
|---|---|---|---|
| WO | WO2005/089423 | A2 | 9/2005 |
| WO | WO 2021/160453 | A1 | 8/2021 |

OTHER PUBLICATIONS

U.S. Appl. No. 29/800,121, filed Jul. 19, 2021, Bentivoglio et al.
U.S. Appl. No. 29/800,126, filed Jul. 19, 2021, Bentivoglio et al.
International Search Report and Written Opinion regarding PCT/US2022/028267 dated Oct. 5, 2022.

* cited by examiner

PILATES REFORMER

CROSS-REFERENCE TO RELATED APPLICATIONS

This application is a continuation application of U.S. patent application Ser. No. 17/719,874, filed Apr. 13, 2022, which claims priority from U.S. Provisional Application No. 63/197,004, filed Jun. 4, 2021, and U.S. Provisional Application No. 63/233,011, filed Aug. 13, 2021, each of which are hereby fully incorporated by reference herein in their entireties.

BACKGROUND

The present disclosure relates to a fitness apparatus, specifically, a pilates reformer, and more specifically, an "at-home" pilates reformer offering virtual, live and/or interactive fitness instruction, having desirable aesthetic qualities, and the ability to collapse for ease of transport and/or storage purposes.

SUMMARY

One general aspect of the present disclosure includes a reformer, including a frame extending between a first end portion and a second end portion; a carriage slidably coupled to the frame, where the carriage is movable along at least a portion of the length of the frame; and a screen assembly rotatably coupled to the frame at the second end portion of the frame.

Another general aspect of the present disclosure includes a reformer, including a frame extending between a first end portion and a second end portion; and a carriage slidably coupled to the frame, where the carriage is movable along at least a portion of the length of the frame, where the carriage is configured to be selectively and releasably coupled to the first end portion of the frame or the second end portion of the frame.

Another general aspect of the present disclosure includes a reformer, including a frame extending between a first end portion and a second end portion; a carriage slidably coupled to the frame, where the carriage is movable along at least a portion of the length of the frame, where the carriage includes an upper portion and a lower portion, the lower portion extending underneath the frame and wrapping around at least a portion of the frame.

Another general aspect of the present disclosure includes a carriage for an exercise machine, including a platform and a support frame configured for supporting the platform, where the support frame extends downward from the platform a first distance, then extends inward, and then extends upward a second distance, and where the support frame includes at least one moving member disposed between the platform and a bottom section of the support frame.

Another general aspect of the present disclosure includes a carriage, including a platform and a support frame configured for supporting the platform, where the support frame includes at least one spring or pneumatic cylinder extending between a first end and a second end, where the first end of the at least one spring or pneumatic cylinder is configured to selectively engage a first connection mechanism of a frame, and where the second end of the at least one spring or pneumatic cylinder is configured to selectively engage a second connection mechanism of the frame.

Another general aspect of the present disclosure includes a reformer, including a base extending between a first end and a second end; a carriage slidably supported by the base; a screen assembly rotatably coupled to the base at the second end of the base, where the screen assembly is configured to be rotatable from a first position, generally perpendicular to the base, to a second position, generally parallel to the base; and a wheel assembly extending outwardly from the first end of the base, where the wheel assembly is configured to allow the reformer to stand in a substantially upright position.

Another general aspect of the present disclosure includes a reformer, including a frame extending between a first end portion and a second end portion; and a carriage slidably coupled to the frame, where the carriage is movable along a length of the frame, and where the carriage is configured to be selectively and releasably coupled to the first end portion of the frame, and selectively and releasably coupled to the second end portion of the frame.

Another general aspect of the present disclosure includes a reformer, including a frame extending between a first end portion and a second end portion; a carriage slidably supported by the frame and movable between the first end portion and the second end portion; and a screen assembly rotatably coupled to the frame at the second end portion of the frame, where the screen assembly is configured to be rotatable from a first position, generally perpendicular to a longitudinal axis of the frame, to a second position, generally parallel to the longitudinal axis of the frame.

Another general aspect of the present disclosure includes a reformer, including a frame extending between a first end portion and a second end portion; a carriage slidably supported by the frame; a screen assembly rotatably coupled to the frame at the second end portion of the frame, where the screen assembly is configured to be rotatable from a first position, generally perpendicular to a longitudinal axis of the frame, to a second position, generally parallel to the longitudinal axis of the frame, such that a center of gravity of the reformer is shifted towards the first end portion of the frame; and a handle disposed at the second end portion of the frame, where the handle is configured to allow the second end portion of the frame to be lifted away from a surface on which the reformer is disposed, and rotated about the first end portion of the frame that is still on the surface.

A reformer according to the present disclosure may include any combination of the features described above and/or the original as-filed claims.

Other systems, methods, features and advantages of the invention will be, or will become, apparent to one with skill in the art upon examination of the following figures and detailed description. It is intended that all such additional systems, methods, features and advantages be within the scope of the invention.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENT

Figure 1:
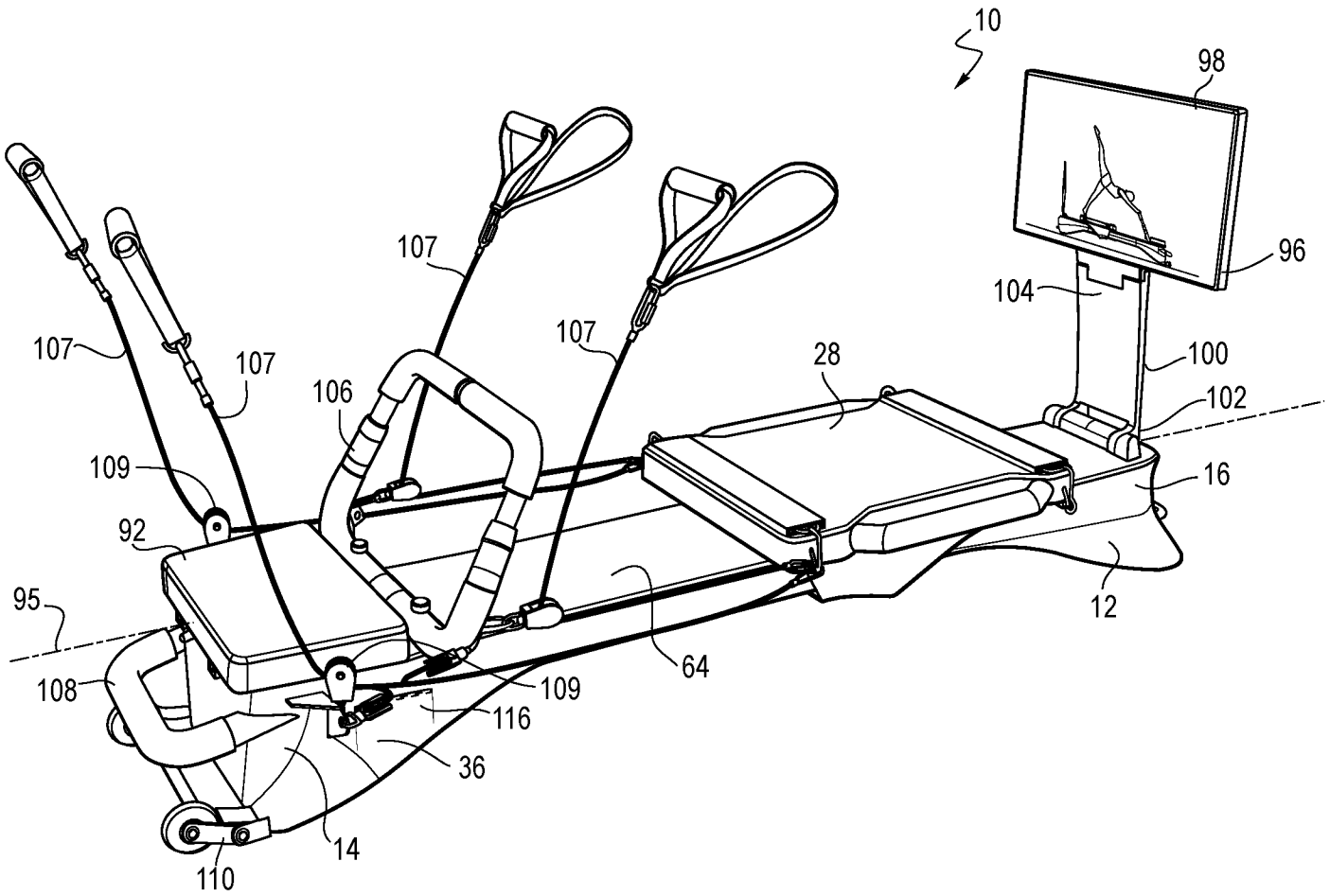
FIG. 1 is a perspective view of a pilates reformer in an unfolded state, according to an embodiment of the present invention, including a base with a cover disposed thereon, a carriage, a platform, a screen assembly, and actuation mechanisms disposed on opposite ends of the pilates reformer.

Various aspects are described below with reference to the drawings in which like elements generally are identified by like numerals. The relationship and functioning of the various elements of the aspects may better be understood by reference to the following detailed description. However, aspects are not limited to those illustrated in the drawings or explicitly described below. It also should be understood that the drawings are not necessarily to scale (although certain drawings may be drawn to scale and relied upon as such), and in certain instances details may have been omitted that are not necessary for an understanding of aspects disclosed herein, such as conventional material, construction, and assembly.

For purposes of promoting an understanding of the presently disclosed embodiments, reference will now be made to the embodiments illustrated in the drawings, and specific language will be used to describe the same. It should nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

In the present application, the term "configured to" is used to describe structural limitations in a particular manner that requires specific construction to accomplish a stated function and/or to interface or interact with another component (s), and is not used to describe mere intended or theoretical uses. Relative terminology and broader terms such as "generally," "about," "substantially," and the like will be understood by those of skill in the art as providing clear and definite scope of disclosure and/or claiming. For example, the term "substantially perpendicular to the surface 105" will be understood as not requiring exactly 90 degrees relative to the surface 105, but rather including that and functional equivalents.

Referring to FIGS. 1-30, embodiments of a pilates reformer (hereinafter "reformer") and some of their components are shown. Features discussed below with respect to one embodiment of the reformer can be incorporated into other embodiments of the reformer. Accordingly, similar features in different embodiments will not be repeated in detail.

Figure 2:
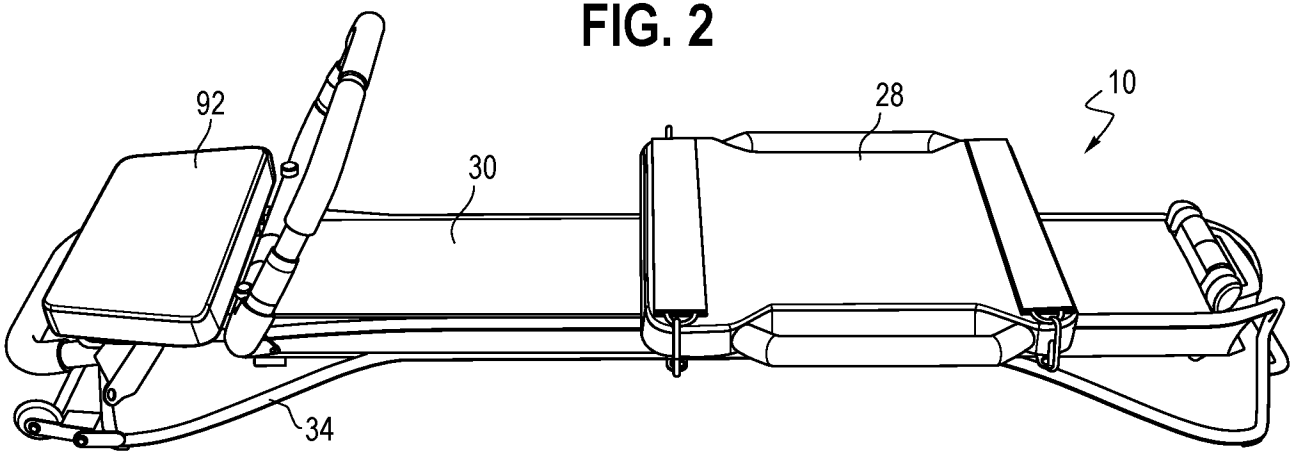
FIG. 2 is another perspective view of the pilates reformer of FIG. 1, with the cover and screen assembly removed, showing the base including a plate and a metal tubing disposed underneath the carriage.
Figure 3:
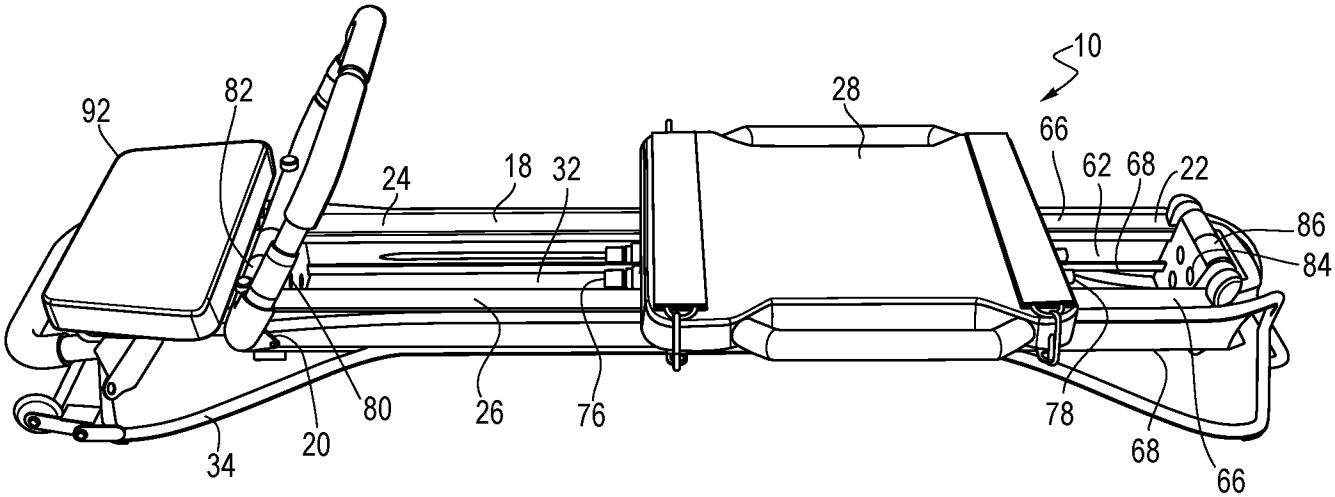
FIG. 3 is another perspective view of the pilates reformer of FIG. 2, with the plate removed, showing a frame disposed underneath the carriage.

In some embodiments, as shown in FIGS. 1-4, the reformer 10 includes a base 12 extending between a first end 14 and a second end 16, and a carriage 28 slidably supported by the base 12. The base 12 includes a frame 18 extending between a first end portion 20 and a second end portion 22 (e.g., as shown in FIG. 3). The frame 18 includes a first rail 24 and a second rail 26 that are spaced apart and extending along at least a portion of the length of the frame 18. The carriage 28 is slidably coupled to the frame 18 (discussed in greater detail below) and is movable along at least a portion of the length of the frame 18. In some embodiments, referring to FIGS. 2 and 3, the base 12 also includes a plate 30 disposed between the carriage 28 and the frame 18, where the plate 30 is configured to cover the first rail 24, the second rail 26, and a gap 32 between the first rail 24 and the second rail 26. With this plate 30, no moving parts of the reformer 10 will be exposable (e.g., the springs and wheels, discussed in greater detail below). This configuration is advantageous as it shields a user from internal components of the reformer 10, thereby preventing clothing, hair, and/or body parts from accidental and unsafe engagement with internal components of the reformer (e.g., springs and wheels, discussed in greater detail below).

Figure 4:
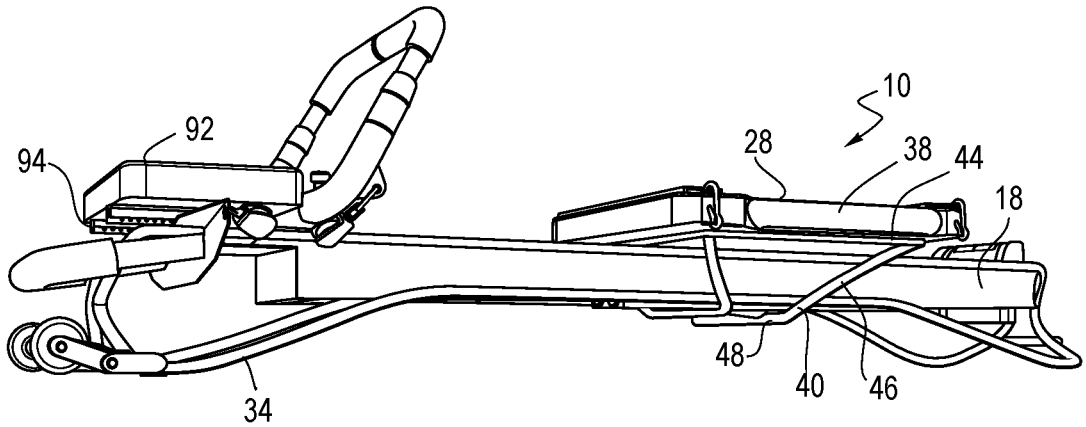
FIG. 4 is another perspective view of the pilates reformer of FIG. 3, showing the carriage attached to the frame from below and the platform mounted on a pair of tracks.

In some embodiments, the base 12 also includes a metal tubing 34 (e.g., as shown in FIGS. 2-4) configured to at least partially extend around the periphery of the frame 18 (or the periphery of the plate 30, when the plate 30 is disposed on the frame 18) and at least partially extend downwardly from the frame 18 or the plate 30, such that when the base 12 is positioned on a plane, the metal tubing 34 will provide support to other parts of the reformer 10 (e.g., provide support to the frame 18, the plate 30, and the carriage 28).

Figure 5:
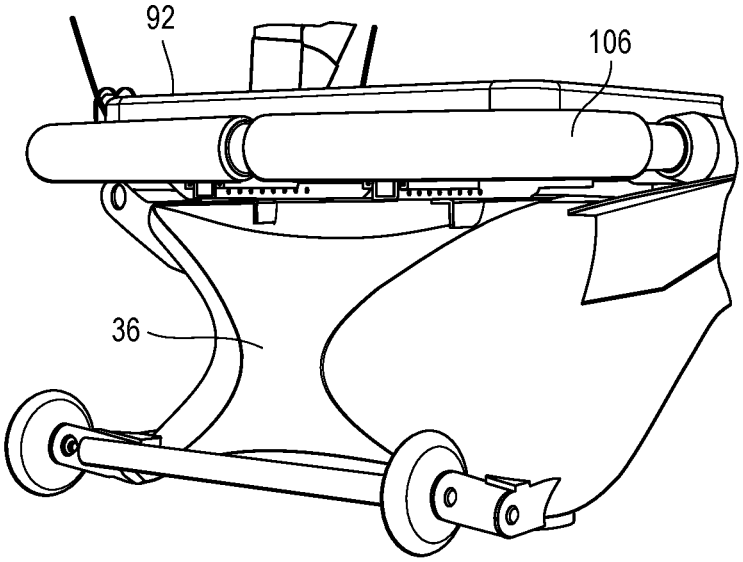
FIG. 5 is a partially enlarged end view of the pilates reformer of FIG. 1, showing a pair of bars laid generally parallel to the base.

In some embodiments, as shown in FIGS. 1 and 5, a cover 36 may be provided to at least partially extend over the base 12, at least partially covering some components of the reformer 10 (e.g., at least partially covering the plate 30, the frame 18, and the metal tubing 34). That is, the cover 36 is disposed between the carriage 28 and the plate 30. In some embodiments, as shown, the cover 36 may conform to the contours of the frame 18. In other embodiments, the cover 36 may comprise other shapes or profiles (e.g., as a rectangular box). The cover 36 may be made of any suitable materials for the intended use, including but not limited to, fabric, mesh, as well as rigid materials (e.g., plastic or aluminum). In some embodiments, the cover 36 may comprise a veneer, providing a variety of aesthetic finishes (e.g. wood grain, metallic, fabric, etc.). Covering the base 12 with a cover 36 is advantageous as it provides a desirable aesthetic appearance, suitable for display in "at-home" settings, and easy to clean, while also shielding a user from internal components of the reformer 10, thereby preventing clothing, hair, and/or body parts from accidental and unsafe engagement with internal components of the reformer 10 (e.g., springs and wheels, discussed in greater detail below).

Figure 22:
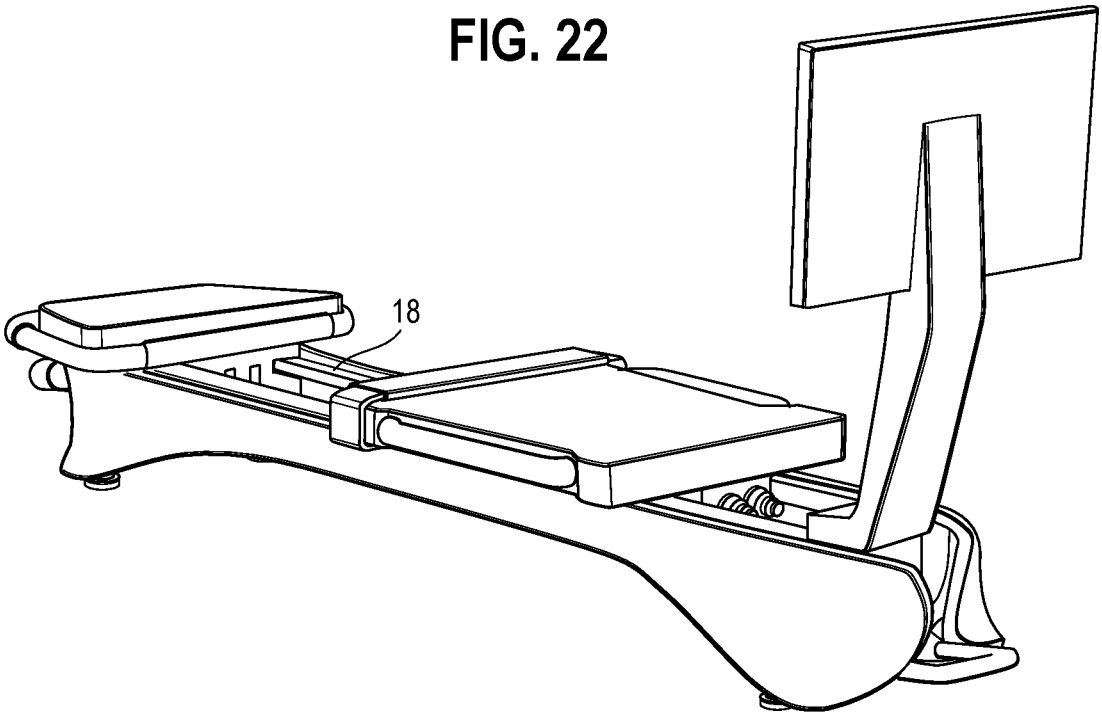
FIG. 22 is a perspective view of another embodiment of a pilates reformer.
Figure 23:
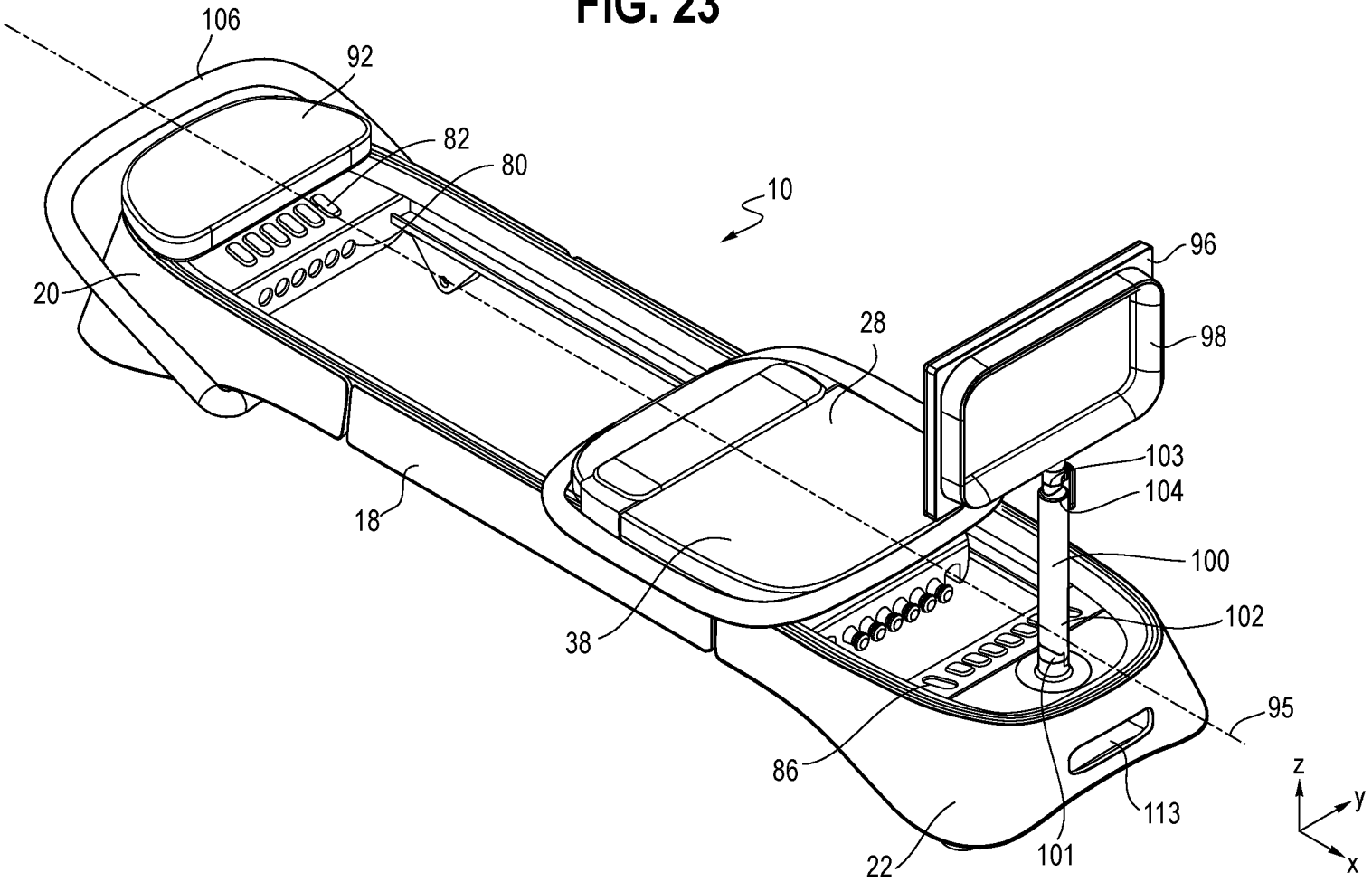
FIG. 23 is a perspective view of another embodiment of a pilates reformer.

In some embodiments, the plate 30 and/or the cover 36 may be optional. For example, as shown in FIGS. 22 and 23, the plate 30 is removed, the central portion of the cover 36 is removed, and the carriage 28 is slidably supported by the frame 18 and movable between the first end portion 20 and the second end portion 22 of the frame 18. Advantageously, when the plate 30 and/or the cover 36 is at least partially or entirely removed, the reformer 10 is lighter. Unlike conventional reformers, which are relatively large and utilize heavy materials, the reformer 10 in the present application is relatively small and utilizes lighter materials, such as aluminum, plastic composite, nylon, plywood, foam, vinyl, polyester, fabric, such that the reformer 10 is lighter and has a relatively low profile. As a consequence, the weight of the reformer can be minimized. In some embodiments, the weight of the reformer 10 is less than 145 pounds, preferably, the weight of the reformer 10 is less than 140 pounds, and more preferably, the weight of the reformer 10 is less than 135 pounds. A lighter reformer is ideal for at-home use, as it is easier for a user to move the reformer between different locations, to fold the reformer and store it in different locations (e.g., under a bed or in a closet)/different positions (e.g., in a substantially horizontal or upright position).

Referring to FIGS. 3, 4, and 6-8, in some embodiments, the carriage 28 includes an upper portion 38 (e.g., a platform 38) and a support frame 39 configured for supporting the platform 38. The support frame 39 generally extends downward from the platform 38 a first distance 45, then extends inward, and then extends upward a second distance 47, where the first distance 45 is greater than the second distance 47. It should be appreciated that the support frame 39 may extend in any one or more directions or angles as it extends downward from the platform 38, inward, and then upward. It should be appreciated that the support frame 39 may include multiple members, e.g., one member that extends downward, another member that extends inward, and another member that extends upward, or one member that extends downward and then inward and another member that extends upward. The support frame 39 includes at least one moving member 60, disposed between the platform 38 and a bottom section of the support frame 39, and configured for movably engaging the frame 18, as discussed in greater detail below.

Figure 6:
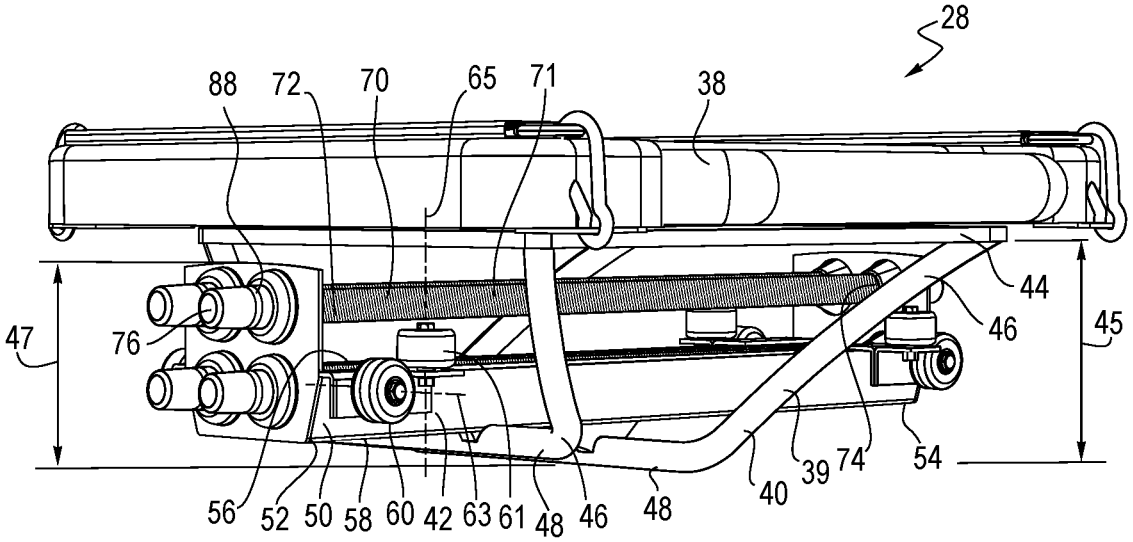
FIG. 6 is a perspective view of the carriage of FIG. 4, including an upper portion, a lower portion, and springs disposed therebetween.

In some embodiments, the support frame 39 may include a lower portion 40 and a middle portion 42 disposed between the upper portion 38 and the lower portion 40. The upper portion 38 may include a padding material applied to add comfort for a user of the reformer. The lower portion 40 is configured as rigid tubing to support the upper portion 38 thereon, at least partially extends underneath the frame 18, and wraps around at least a portion of the frame 18. In some embodiments, as shown in FIGS. 4 and 6, the lower portion 40 includes an upper plate 44, which is disposed above the frame 18 and is configured for supporting the upper portion 38. The lower portion 40 also includes at least one leg 46 (e.g., two legs 46, as shown in FIG. 6) extending downwardly from the upper plate 44, where the bottom section 48 of the at least one leg 46 extends underneath the frame, such that the at least one leg 46 wraps around at least a portion of the frame 18 (e.g., as shown in FIG. 4).

In some embodiments, as shown in FIG. 6, the middle portion 42 of the carriage 28 is disposed and secured on the bottom section 48 of the at least one leg 46. The middle portion 42 includes an elongate member 50 extending between a first end portion 52 and a second end portion 54. The elongate member 50 includes a first side wall 56 and a second side wall 58 extending between the first end portion 52 and the second end portion 54. Each of the first side wall 56 and the second side wall 58 includes at least one moving member 60 (e.g., a wheel 60 on the second side wall 58, as shown in FIG. 6) configured for moving (e.g., rolling) in the first rail 24 and the second rail 26 of the frame 18, respectively, when the carriage 28 is mounted on the frame 18, such that the carriage 28 is slidably movable along at least a portion of the length of the frame 18. The configuration, positioning, and number of the moving member 60 may be varied, as desired and/or needed, depending on the configuration of the first and second rails 24 and 26 of the frame 18, without departing from the scope of the present invention, as long as the moving member 60 may cause the carriage 28 to slidably move along at least a portion of the length of the frame 18.

Figure 7:
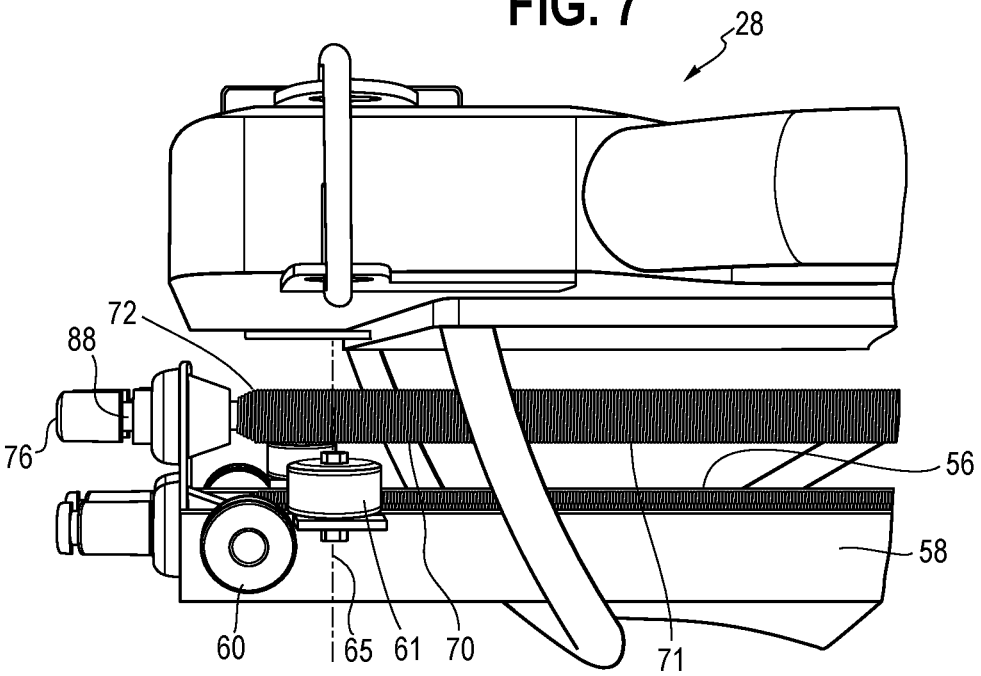
FIG. 7 is an enlarged perspective view of a portion of the carriage of FIG. 6, showing connecters for one end of the springs and wheels disposed at one end of the carriage.
Figure 8:
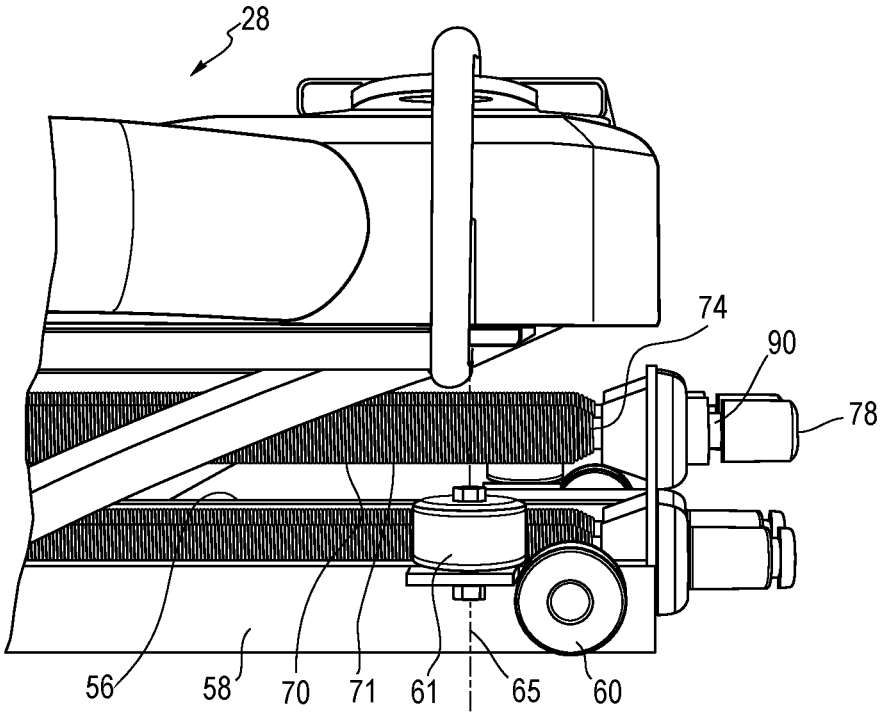
FIG. 8 is another enlarged perspective view of a portion of the carriage of FIG. 6, showing connectors for the other end of the springs and wheels disposed at the other end of the carriage.

In some embodiments, as shown in FIGS. 6-8, each of the first side wall 56 and the second side wall 58 includes at least a first moving member 60 (e.g., a first wheel 60 on the second side wall 58, as shown in FIG. 6, which is configured to rotate around a first axis 63) and a second moving member 61 (e.g., a second wheel 61 on the second side wall 58, as shown in FIG. 6, which is configured to rotate around a second axis 65) configured for moving (e.g., rolling) in the first rail 24 and the second rail 26 of the frame 18, respectively, when the carriage 28 is mounted on the frame 18, such that the carriage 28 is slidably movable along at least a portion of the length of the frame 18. The first axis 63 may extend perpendicular to the second side wall 58 and the second axis 65 may extend parallel to the second side wall 58 and perpendicular to the first axis 63. This configuration of the first and second moving members 60 and 61 is advantageous in that the first moving member 60 supports the load, while the second moving member 61 prevents lateral or side to side movement, thereby providing a smooth glide between the first and second end portions 20 and 22 of the frame 18. The configuration, positioning, and number of the first and second moving members 60 and 61 may be varied, as desired and/or needed, depending on the configuration of the first and second rails 24 and 26 of the frame 18, without departing from the scope of the present invention, as long as the intended use and functions discussed above may be achieved. For example, in some embodiments, the first and second moving members 60 and 61 may be mechanical bearings or any type of high lubricity/low friction surfaces configured to accommodate smooth sliding engagement between the carriage 28 and the frame 18.

Referring to FIGS. 1, 3, 4, and 6, each of the first rail 24 and the second rail 26 includes an upper surface 66, a lower surface 68, and a groove 62 disposed between the upper surface 66 and the lower surface 68. The grooves 62 of the first rail 24 and the second rail 26 face each other and extend between the first end portion 20 and the second end portion 22 of the frame 18. The frame 18 and the carriage 28 are configured such that, when the carriage 28 is mounted on the base 12, the upper portion 38 of the carriage 28 and the upper plate 44 of the lower portion 40 of the carriage 28 are disposed above the upper surface 64 of the base 12 (e.g., as shown in FIG. 1, where the upper surface 64 is covered by a cover 36), and the at least one leg 46 of the lower portion 40 wraps around at least a portion of the base 12 (e.g., wraps around at least a portion of the frame 18, the plate 30, and the metal tubing 34), with the bottom section 48 of the at least one leg 46 extends underneath the frame 18, such that the middle portion 42 of the carriage 28 extends in-between the first rail 24 and the second rail 26, from below, and such that the moving members 60 (e.g., wheels 60) disposed on the first side wall 56 and the second side wall 58 of the elongate member 50 are slidably received in the opposing grooves 62 of the first rail 24 and the second rail 26, respectively.

With this configuration, the grooves 62 of the first and second rails 24 and 26 are not open from the top and the moving members 60 (e.g., wheels 60) of the carriage 28 are invisibly received in the grooves 62, which is advantageous for shielding a user from the moving members 60 (e.g., wheels 60), thereby preventing clothing, hair, and/or body parts from accidental and unsafe engagement with the moving members 60 (e.g., wheels 60). This configuration is also advantageous for allowing a cover 36 to be wrapped around the base 12 without affecting the use of the reformer 10 (e.g., without affecting the movement of the carriage 28 on the upper surface 64 of the base 12). In some embodiments, as shown in FIG. 23, the carriage 28 does not have components that extend underneath the frame 18 or wrap around the frame 18 (e.g., as compared to the carriage 28 shown in FIG. 4), which facilitates reducing the weight of the reformer 10, without departing from the scope of the present invention.

Figure 29:
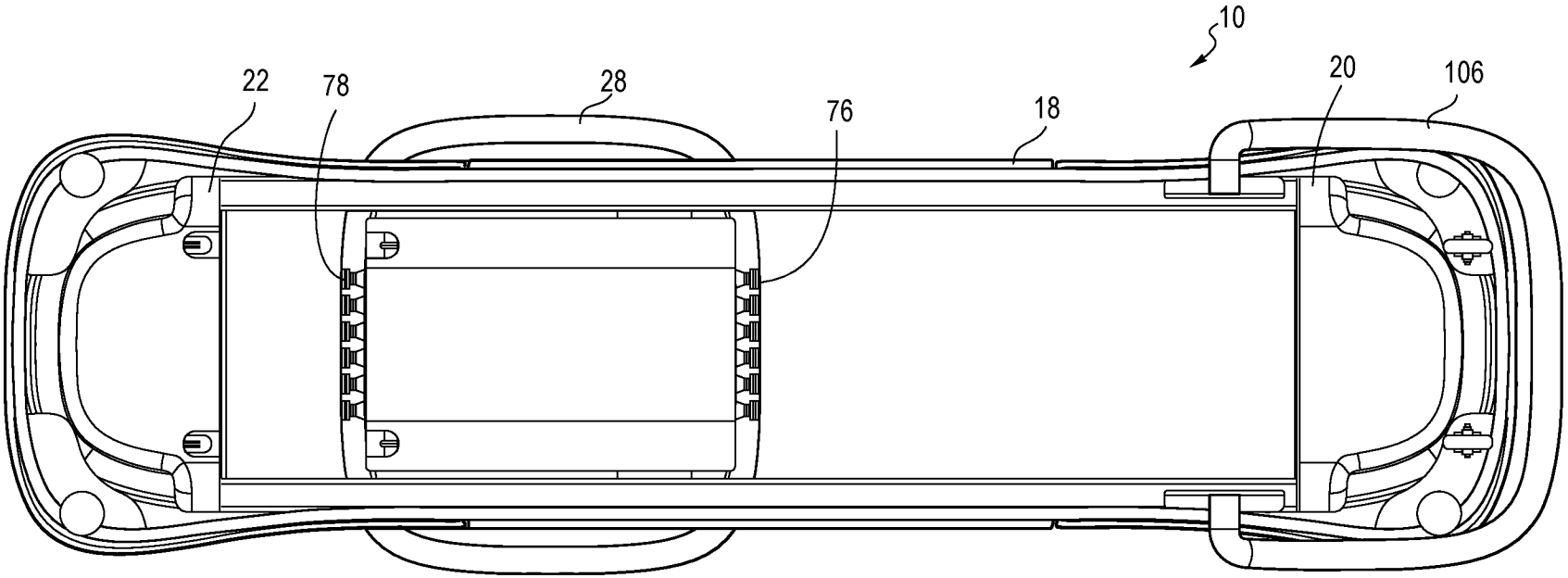
FIG. 29 is a bottom view of the reformer of FIG. 23.

Referring to FIGS. 1-3, 6-10, 23, and 29, the carriage 28 is configured to be selectively and releasably coupled to the first end portion 20 of the frame 18, and selectively and releasably coupled to the second end portion 22 of the frame 18. For example, as shown in FIGS. 6-8, the middle portion 42 of the carriage 28 includes at least one spring 70 (e.g. four springs in two rows as shown in FIG. 8; six springs in one row as shown in FIGS. 23 and 29) extending between a first end 72 and a second end 74 underneath the upper portion 38 (e.g., the platform 38) of the carriage 28. The first end 72 of the at least one spring 70 is configured to selectively engage a first connection mechanism of the frame 18 and the second end 74 of the at least one spring 70 is configured to selectively engage a second connection mechanism of the frame 18, as discussed in greater detail below. Positioning the at least one spring 70 entirely under the upper portion 38 of the carriage 28 is advantageous for shielding a user from the at least one spring 70, thereby preventing clothing, hair, and/or body parts from accidental and unsafe engagement with the at least one spring 70. In some embodiments, the at least one spring 70 may be housed inside a tube 71, so that the spring(s) are not exposed, thereby limiting or preventing potential safety issues.

A first connector 76 is coupled to the first end 72 of the at least one spring 70 and configured to be releasably coupled to the first end portion 20 of the frame 18. A second connector 78 (e.g., as shown in FIGS. 8 and 29) is coupled to the second end 74 of the at least one spring 70 and configured to be releasably coupled to the second end portion 22 of the frame 18. In some embodiments, the first end portion 20 of the frame 18 includes a first actuation mechanism 82, where the first actuation mechanism 82 is configured to selectively and releasably engage the first connector 76, and the second end portion 22 of the frame 18 includes a second actuation mechanism 86, where the second actuation mechanism 86 is configured to selectively and releasably engage the second connector 78.

As shown in FIGS. 3, 23, and 29, the first end portion 20 of the frame 18 includes at least a first receptacle 80 and a first actuation mechanism 82 (e.g., a first switch 82). The first receptacle 80, the first actuation mechanism 82, and the first connector 76 are configured such that when the first actuation mechanism 82 is in a first state, the first connector 76 is received in the first receptacle 80 and coupled to the first end portion 20 of the frame 18 (e.g., via a first groove 88 on the first connector 76, as shown in FIGS. 6 and 7), and when the first actuation mechanism 82 is in a second state, the first connector 76 is decoupled from the first end portion 20 of the frame 18.

In some embodiments, manipulation of the first actuation mechanism 82 selectively moves a connection mechanism (e.g., a gripping mechanism) into engagement with or disengages the connection mechanism from the first connector 76. Movement of the connection mechanism may be accomplished by any suitable mechanical and/or electromechanical means, including but not limited to a series of gears, springs, tracks, linkages, and/or servo motors. In some embodiments, the first actuation mechanism 82 may be a push button/switch, where a user may push the first actuation mechanism 82 downwards to move the connection mechanism downwards, into engagement with the first connector 76, and locked in place, and where a user may further push the first actuation mechanism 82 again to disengage the connection mechanism from the first connector 76 and move the connection mechanism upwards.

Figure 30:
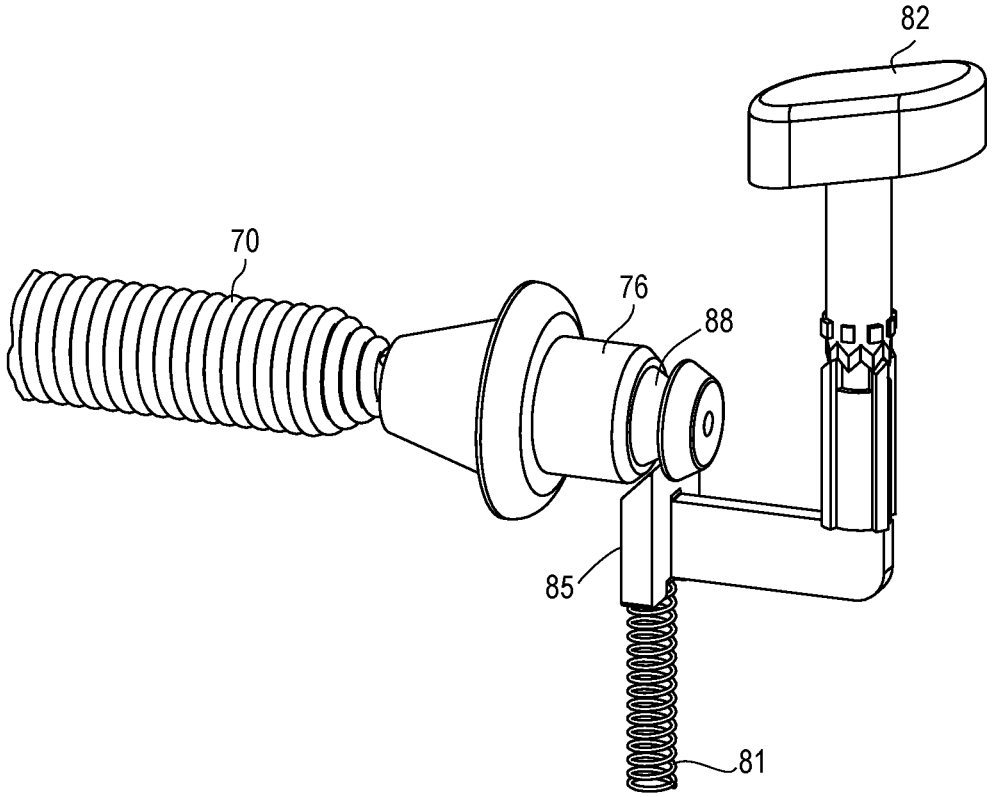
FIG. 30 is an illustration of an embodiment of the actuation mechanism, the connection mechanism, and the connector coupled to a spring.

For example, as shown in FIG. 30, the first actuation mechanism 82 is a push button and is in the first state, which allows a biasing mechanism (e.g., spring) 81 to bias the connection mechanism (e.g., latch/lock) 85 upwards to an upper position, such that the latch/lock 85 engages the first connector 76 (e.g., via the first groove 88 on the first connector 76). A user may push the first actuation mechanism (e.g., button) 82 downwards to move the button 82 from the first state to the second state, which moves the connection mechanism (e.g., latch/lock) 85 downwards to a lower position, such that the latch/lock 85 disengages the first connector 76. When the user releases the button 82, the latch/lock 85 may stay in the lower position. By pushing the button 82 downwards again, the latch/lock 85 is biased up by the spring 81 to the upper position, such that the button 82 returns to the first state and may stay there when the user releases the button 82. The button 82 may work in a manner similar to a button of a clickable pen (for example, where pushing the button once advances the pen tip, and pushing the same button again retracts the pin tip).

The button 82, the latch/lock 85, and the spring 81 are configured such that when the latch/lock 85 is in the upper position, if the first connector 76 moves into the first receptacle 80, the first connector 76 will contact the latch/lock 85, urge the latch/lock 85 to move downwards first against the biasing force of the spring 81, and as the first connector 76 continues to move into the first receptacle 80, it allows the spring 81 to bias the latch/lock 85 upwards into engagement with the first groove 88 on the first connector 76. This configuration is advantageous for preventing the first connector 76 from damaging by allowing the latch/lock 85 to move down and out of the way if the first connector 76 moves into the first receptacle 80 when the button 82 is in the first state. This configuration is also advantageous for permitting the first connector 76 to couple to the end of the reformer, even when the latch/lock 85 is in the upper position, thereby allowing a user to complete the coupling, even though the latch/lock 85 is not in the intended (down) position for coupling.

Alternatively, in some embodiments, the first actuation mechanism 82 may be configured such that a user may push the first actuation mechanism 82 downwards to move the connection mechanism downwards, into engagement with the first connector 76, and then by rotating the first actuation mechanism 82 in a first direction, to lock the connection mechanism in place. To unlock the connection mechanism, a user may rotate the first actuation mechanism 82 in an opposite second direction, and then by pulling the first actuation mechanism 82 up, a user may disengage the connection mechanism from the first connector 76 and move the connection mechanism upwards.

Figure 19:
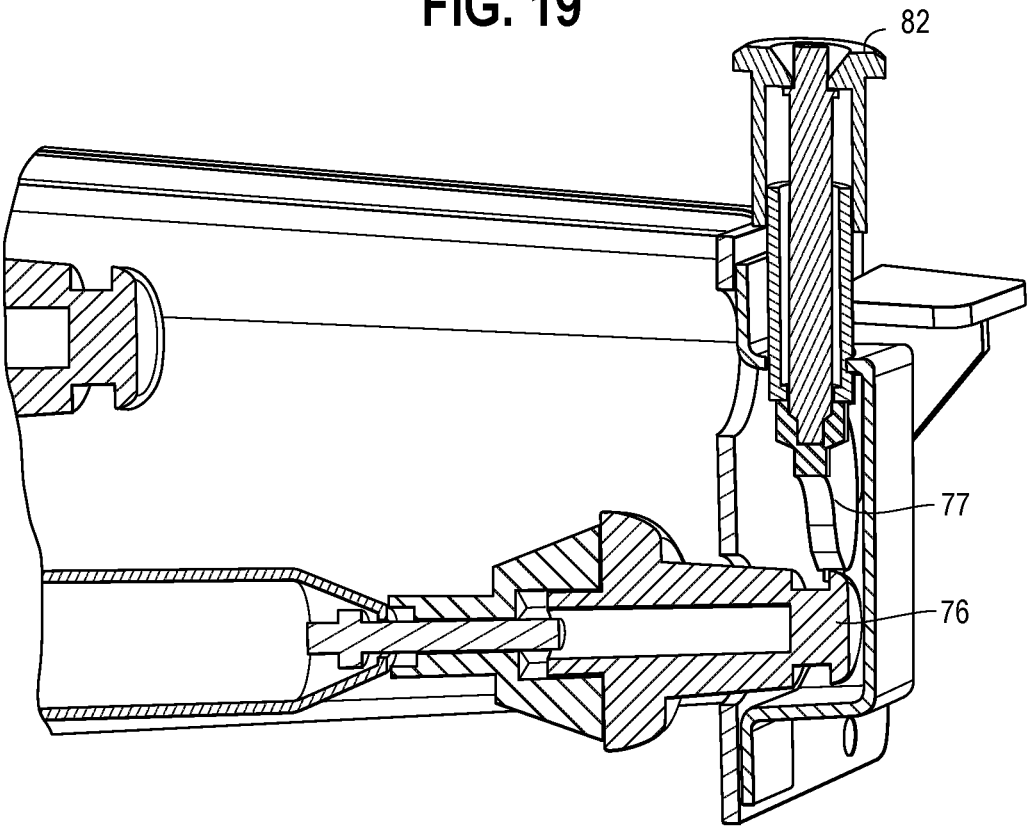
FIGS. 19 and 20 are illustrations of an example of an actuation mechanism, a connection mechanism, a connector coupled to an end of a spring, and the connection therebetween.
Figure 20:
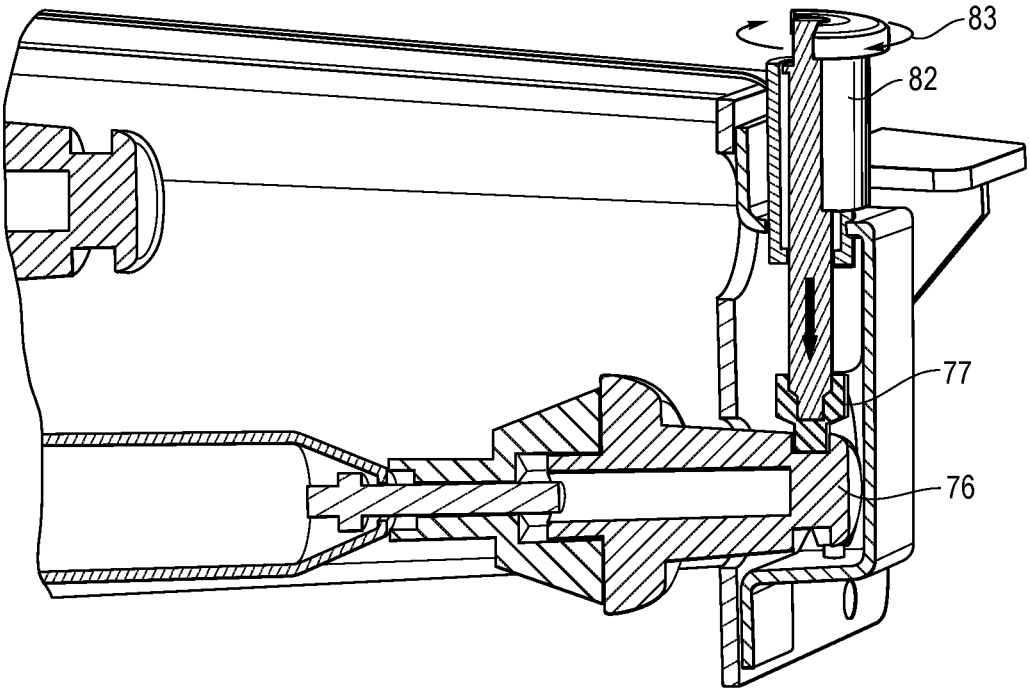

In some embodiments, for example, as shown in FIGS. 19 and 20, the first actuation mechanism 82 is configured to be a rotatable actuation mechanism (e.g., in the form of a sleeve), and rotation of the first actuation mechanism 82 (e.g., the sleeve 82) in a first direction 83 (e.g., clockwise; as shown in FIG. 20) causes the connection mechanism 77 to move downward towards the first connector 76 (e.g., via a threaded engagement between the sleeve 82 and another member coupled between the sleeve 82 and the connection mechanism 77), and rotation of the first actuation mechanism 82 (e.g., the sleeve 82) in an opposite second direction (e.g., counterclockwise; not shown) causes the connection mechanism 77 to move upwards away from the first connector 76. In other words, moving the first actuation mechanism 82 to the first state may move the connection mechanism towards the first connector 76, and when the first actuation mechanism 82 is in the first state, the connection mechanism engages the first connector 76 (e.g., as shown in FIG. 20), and moving the first actuation mechanism 82 to the second state may disengage the connection mechanism from the first connector 76 and move the connection mechanism away from the first connector 76. The connection mechanism may be in any suitable form, for example, as shown in FIGS. 19 and 20, the connection mechanism 77 may be in the form of a fork having tines that engage the first connector 76 via the first groove 88 on the first connector 76.

As shown in FIG. 3, the second end portion 22 of the frame 18 includes at least a second receptacle 84 and a second actuation mechanism 86 (e.g., a second switch 86). The second receptacle 84, the second actuation mechanism 86, and the second connector 78 are configured such that when the second actuation mechanism 86 is in a first state, the second connector 78 is received in the second receptacle 84 and coupled to the second end portion 22 of the frame 18 (e.g., via a second groove 90 on the second connector 78, as shown in FIG. 8), and when the second actuation mechanism 86 is in a second state, the second connector 78 is decoupled from the second end portion 22 of the frame 18. In some embodiments, manipulation of the second actuation mechanism 86 selectively moves a connection mechanism (e.g., a gripping mechanism) into engagement with or disengages the connection mechanism from the second connector 78.

For example, moving the second actuation mechanism 86 to the first state may move the connection mechanism towards the second connector 78, and when the second actuation mechanism 86 is in the first state, the connection mechanism engages the second connector 78 (e.g., the connection mechanism may be in the form of a fork and engages the second connector 78 via the second groove 90 on the second connector 78); moving the second actuation mechanism 86 to the second state may disengage the connection mechanism from the second connector 78 and move the connection mechanism away from the second connector 78. Movement of the connection mechanism may be accomplished by any suitable means, including a series of gears and/or linkages. In some embodiments, the second actuation mechanism 86 may be a push button and the connection mechanism may be a latch/lock, as discussed above with respect to the first actuation mechanism 82, and for the sake of brevity, the configuration and the operational mechanism of the second actuation mechanism 86 in the form of a push button will not be repeated.

Any configurations of the first and second connectors 76 and 78 and the corresponding connection mechanisms on the frame 18 may be provided, as desired and/or needed, without departing from the scope of the present invention, as long as the connection mechanisms can selectively engage the first and second connectors 76 and 78, respectively, by manipulating the corresponding actuation mechanisms.

Figure 9:
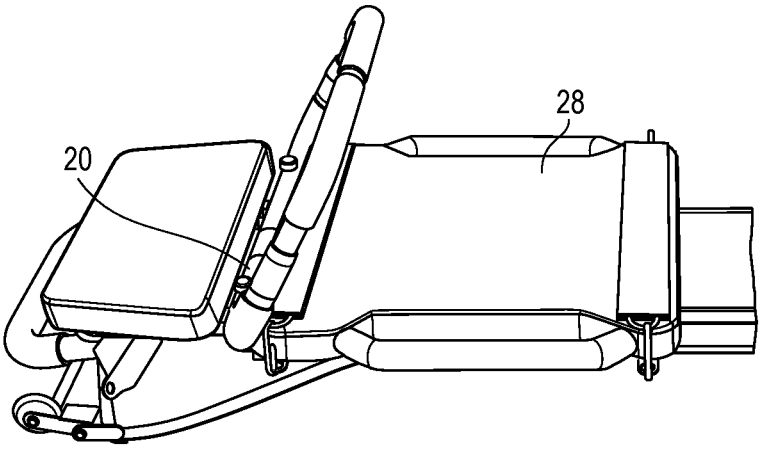
FIG. 9 is an enlarged perspective view of a portion of the pilates reformer of FIG. 1, showing the carriage moved to one end of the pilates reformer.
Figure 10:
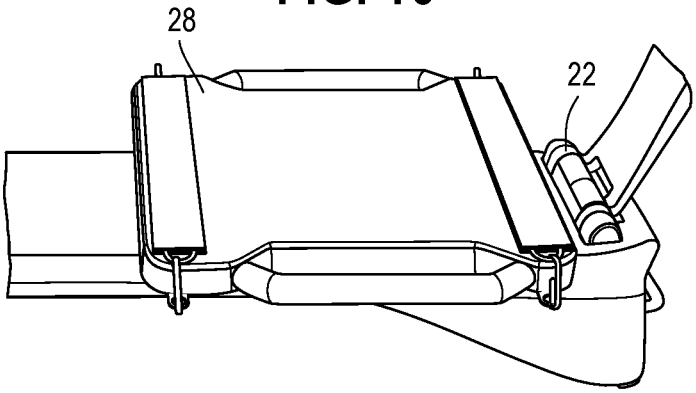
FIG. 10 is another enlarged perspective view of a portion of the pilates reformer of FIG. 1, showing the carriage moved to the other end of the pilates reformer.

With the above configuration of each spring, receptacle, and actuation mechanism, when the carriage 28 is coupled to the first end portion 20 of the frame 18, resistance is provided to the carriage 28 via tension in the spring(s) 70 when the carriage 28 is moved towards the second end portion 22 of the frame 18, and when the carriage 28 is coupled to the second end portion 22 of the frame 18, resistance is provided to the carriage 28 via tension in the spring(s) 70 when the carriage 28 is moved towards the first end portion 20 of the frame 18. Advantageously, this configuration allows the user to selectively and releasably couple the carriage 28 to the first end portion 20 of the frame 18 or the second end portion 22 of the frame 18 (e.g., as shown in FIGS. 9 and 10), as desired and/or needed, to accommodate varying pilates maneuvers, different sized users, and/or the use of other accessories of the reformer (e.g., the platform 92, as shown in FIGS. 1-5, discussed in greater detail below.)

An actuation mechanism (and related connection mechanism) and a receptacle may be provided for each spring, and at each end of the frame 18. The number of springs included in the middle portion 42 of the carriage 28 and the number of receptacles and corresponding actuation mechanisms on each end of the frame 18 may be varied, as desired and/or needed, without departing from the scope of the present invention, as long as each end of each spring can be selectively coupled to or decoupled from a corresponding receptacle on a corresponding end of the frame 18 by transitioning a corresponding actuation mechanism between a first state and a second state.

The carriage 28 can be equipped with any kind of biasing mechanism, although in preferred embodiments, the carriage 28 is equipped with a spring or a pneumatic cylinder. In some embodiments, the at least one spring 70 may be replaced with another structure/member/element, including but not limited to at least one pneumatic cylinder, without departing from the scope of the present invention, as long as when the carriage 28 is coupled to the first end portion 20 of the frame 18, resistance is provided to the carriage 28 when the carriage 28 is moved towards the second end portion 22 of the frame 18, and when the carriage 28 is coupled to the second end portion 22 of the frame 18, resistance is provided to the carriage 28 when the carriage 28 is moved towards the first end portion 20 of the frame 18. The ends of another structure/member/element (e.g., the at least one pneumatic cylinder) may be coupled to respective connection mechanisms on the frame 18 in the same manner as discussed above with respect to the embodiments including at least one spring 70.

Figure 28:
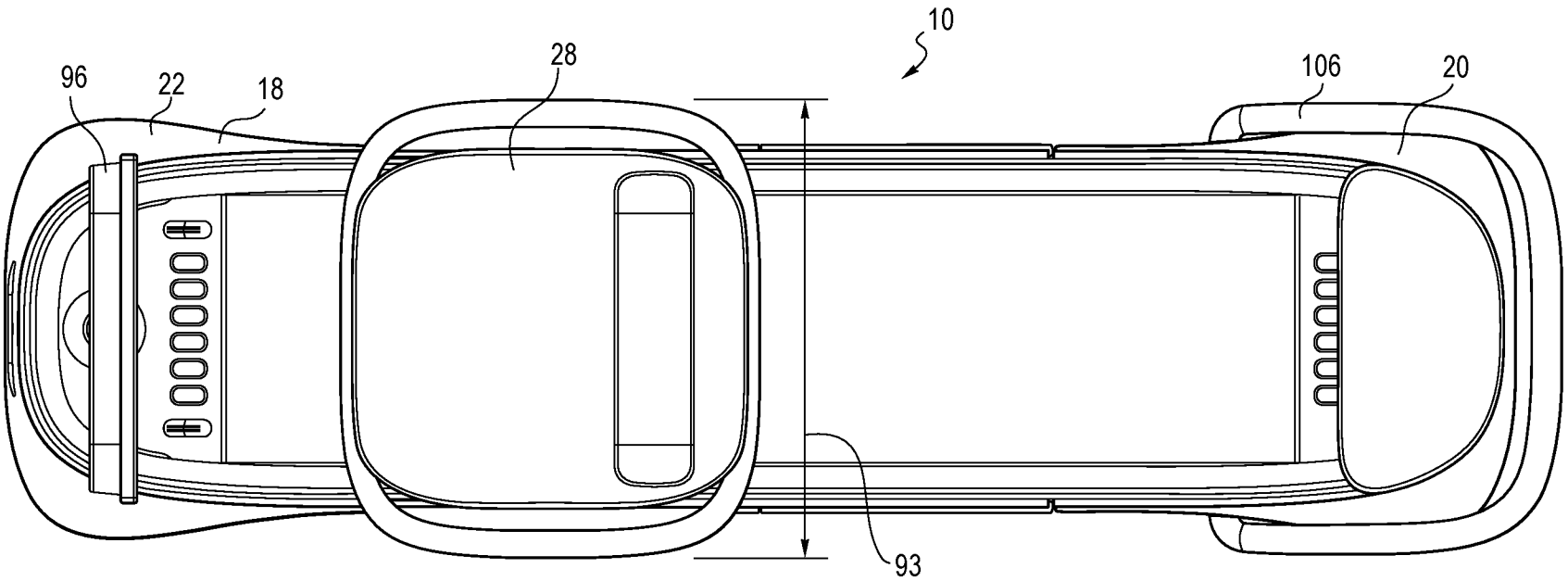
FIG. 28 is a top view of the reformer of FIG. 23.

In some embodiments, as shown in FIGS. 23 and 28, the carriage 28 may include a plurality of springs or a plurality of pneumatic cylinders, where each spring of the plurality of springs or each pneumatic cylinder of the plurality of pneumatic cylinders may offer a different level of resistance to movement of the carriage 28. The first end portion 20 of the frame 18 may include a plurality of first actuation mechanisms 82 (e.g., push button), where each first actuation mechanism of the plurality of first actuation mechanisms is configured to selectively and releasably engage a first end of a spring of the plurality of springs or a first end of a pneumatic cylinder of the plurality of pneumatic cylinders, and the second end portion 22 of the frame 18 may include a plurality of second actuation mechanisms 86 (e.g., push button), where each second actuation mechanism of the plurality of second actuation mechanisms is configured to selectively and releasably engage a second end of a spring of the plurality of springs or a second end of a pneumatic cylinder of the plurality of pneumatic cylinders. For example, a plurality of springs with varying spring resistance may be provided, such that varying combinations of springs with different spring resistance may be selected, by manipulating corresponding actuation mechanisms (e.g., push buttons), to provide varying resistance levels to the carriage 28, as desired and/or needed. Advantageously, the actuation mechanisms allow a user to easily adjust the resistance levels provided to the carriage 28 (e.g., by selectively pressing one or more push buttons), as desired and/or needed, without the need of manually moving the ends of the springs.

In some embodiments, as shown in FIGS. 1-5, the reformer 10 also includes a platform 92 disposed approximate to the first end 14 of the base 12. At least one track 94 may be provided underneath the platform 92, and the platform 92 is configured to slide along at least a portion of the length of the at least one track 94. The platform 92 is also configured to be selectively and releasably secured to varying locations on the at least one track 94, as desired and/or needed. In some embodiments, the platform 92 may slide along the at least one track 94 further away from the second end 16 of the base 12 and be fixed at a desired location to accommodate taller users.

Advantageously, with the carriage 28 being configured to be coupled to the first end portion 20 of the frame 18 or the second end portion 22 of the frame 18 to provide resistance in opposite directions, a single platform 92 can be used in conjunction with the carriage 28 to achieve functions of two platforms disposed on both of the first and second ends 14 and 16 of the base 12. That is, when a carriage is coupled to only one end of a reformer via one or more springs, it only provides resistance to movement in one direction. Thus, to perform a variety of Pilates maneuvers requiring a fixed platform and a carriage that resists movement away from a fixed platform, and a carriage that resists movement toward a fixed platform, multiple platforms are required (e.g., at opposite ends of the reformer). Advantageously, in the embodiments of the present application, the same variety of maneuvers may be performed with a single platform 92, by selectively engaging one or more springs on the carriage 28 at opposing ends of the reformer 10.

Figure 11:
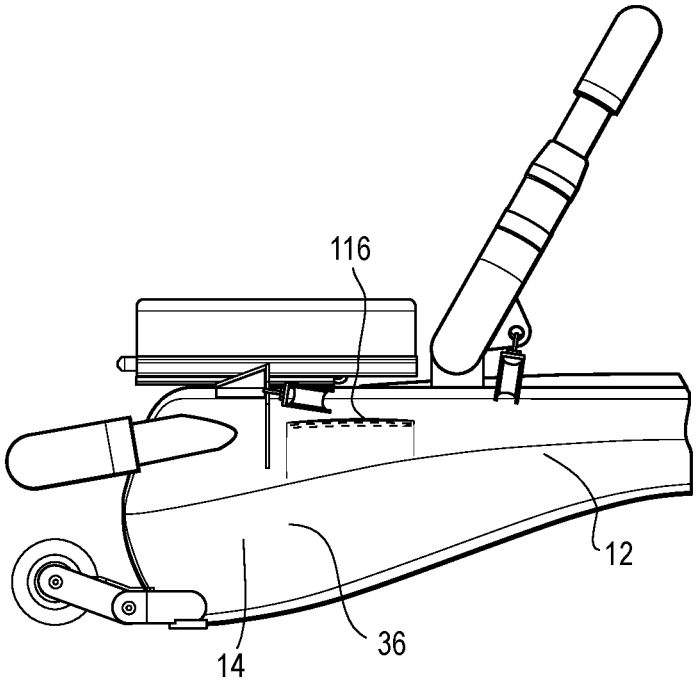
FIG. 11 is another enlarged perspective view of a portion of the pilates reformer of FIG. 1, showing a pocket formed in the cover stretched over the base.
Figure 12:
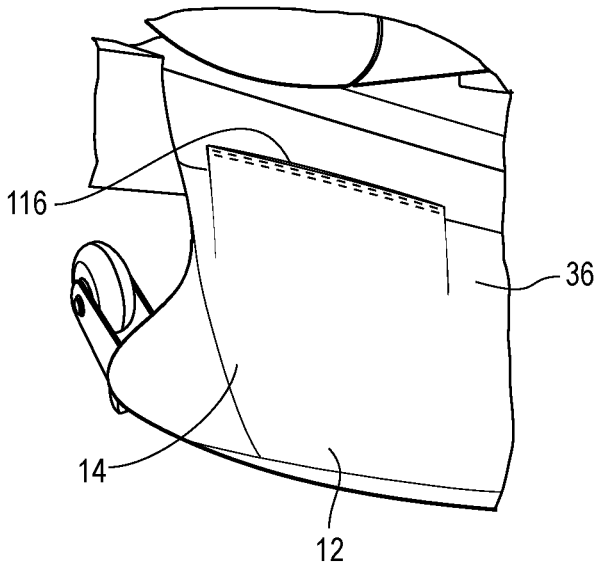
FIG. 12 is a partially enlarged perspective view of the pocket of FIG. 11.

In some embodiments, as shown in FIGS. 11 and 12, pockets 116 with magnetic seams may be formed in the cover 36 on both sides of the base 12 (e.g., at the first end 14 of the base 12). The pockets 116 may be configured to store and conceal optional straps 107, pulleys 109, and/or handles when not in use. Alternatively, other slots, receptacles, and/or shells (with or without magnetic anchor/docking structures, and/or mounting brackets) in the form of a box, a cavity and/or a shelf may be provided on the outside and/or inside of the cover 36 and/or the frame 18 to anchor, dock, store, contain, hold, and/or couple the pulleys/cables/straps.

Figure 27:
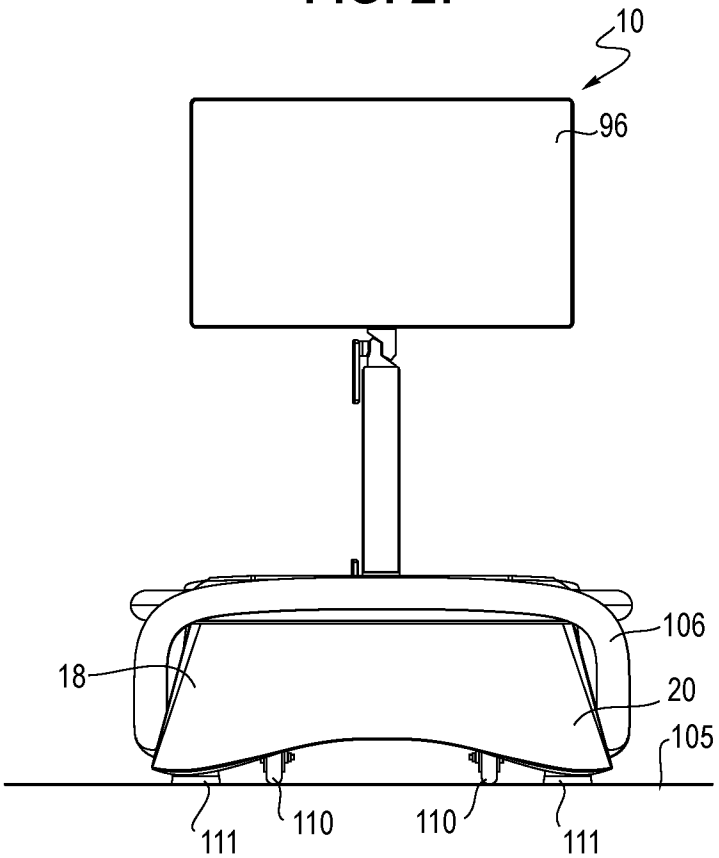
FIG. 27 is a rear view of the reformer of FIG. 23.

In some embodiments, a screen assembly 96 may be rotatably mounted on the base 12 to provide virtual, live and/or interactive fitness instruction. For example, as shown in FIGS. 1, 3, 13 and 14, a screen assembly 96 is rotatably coupled to the frame 18 at the second end portion 22 of the frame 18 (e.g., coupled to the second end 16 of the base 12). The screen assembly 96 is configured to be rotatable from a first position, generally perpendicular to the base 12 or a longitudinal axis 95 of the frame 18 (e.g., as shown in FIGS. 1 and 23), to a second position, generally parallel to the base 12 or the longitudinal axis 95 of the frame 18 (e.g., as shown in FIG. 15, where the reformer is in the folded state), such that a center of gravity of the reformer 10 is shifted towards the first end portion 20 of the frame 18. As the screen assembly 96 and the handle 113 (discussed in greater detail below) are disposed at the same second end portion 22 of the frame 18, the ability of moving the center of gravity of the reformer 10 towards the first end portion 20 of the frame 18 is advantageous for making it easier for a user to lift the second end portion 22 of the reformer 10 (e.g., via the handle 113) away from the surface 105 (e.g., as shown in FIG. 27) for moving and storing the reformer 10.

The screen assembly 96 includes a screen 98 and an arm 100 extending outwardly from the second end portion 22 of the frame 18. The arm 100 extends between a first end portion 102 and a second end portion 104, where the first end portion 102 of the arm 100 is rotatably coupled/connected (e.g., via a first rotatable joint 101, as shown in FIG. 23) to the second end portion 22 of the frame 18, and the screen 98 is rotatably coupled/connected (e.g., via a second rotatable joint 103, as shown in FIG. 23) to the second end portion 104 of the arm 100. The first rotatable joint 101 and the second rotatable joint 103 may be any types of joints, including but not limited to, a ball joint, that permit multiple freedoms of rotation.

In some embodiments, the first rotatable joint 101 may be configured to allow the arm 100 to rotate or pivot about a first axis extending generally perpendicular to the longitudinal axis 95 of the frame 18 in a Z direction, and the first rotatable joint 101 may be configured to allow the arm 100 to rotate or pivot about a second axis extending generally perpendicular to the longitudinal axis 95 of the frame 18 in a Y direction. In some embodiments, the second rotatable joint 103 may be configured to allow the screen 98 to rotate or pivot about the first axis extending generally perpendicular to the longitudinal axis 95 of the frame 18 in the Z direction, and the second rotatable joint 103 may be configured to allow the screen 98 to rotate or pivot about the second axis extending generally perpendicular to the longitudinal axis 95 of the frame 18 in the Y direction.

Figure 13:
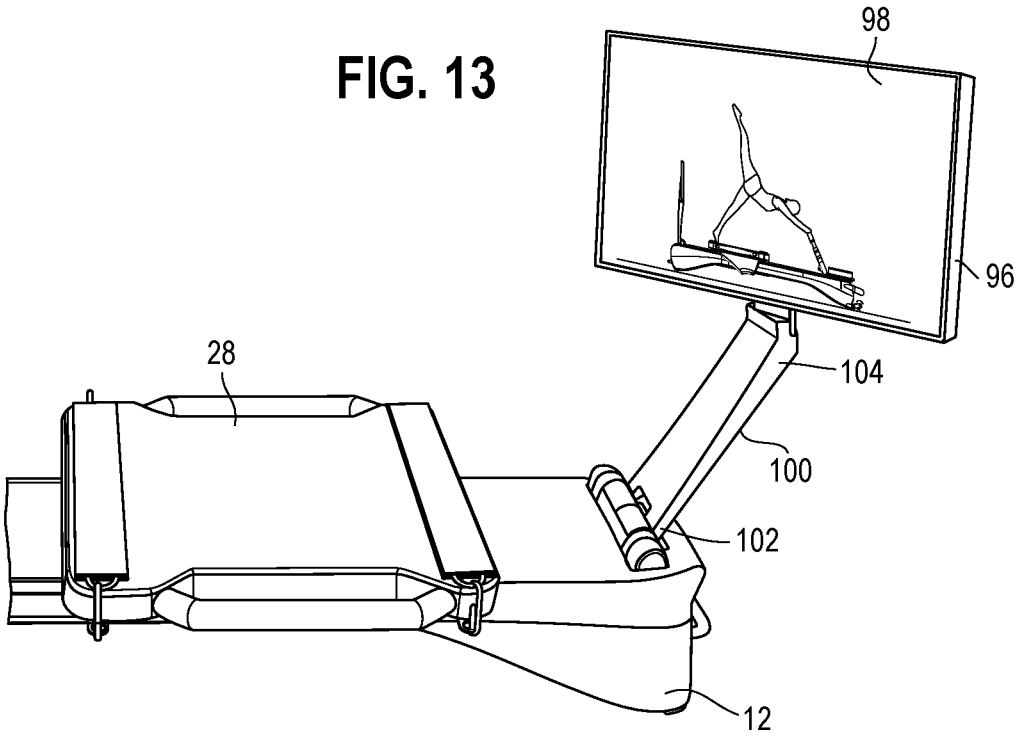
FIGS. 13 and 14 are perspective views of a portion of the pilates reformer of FIG. 1, showing the screen assembly is rotatable.
Figure 14:
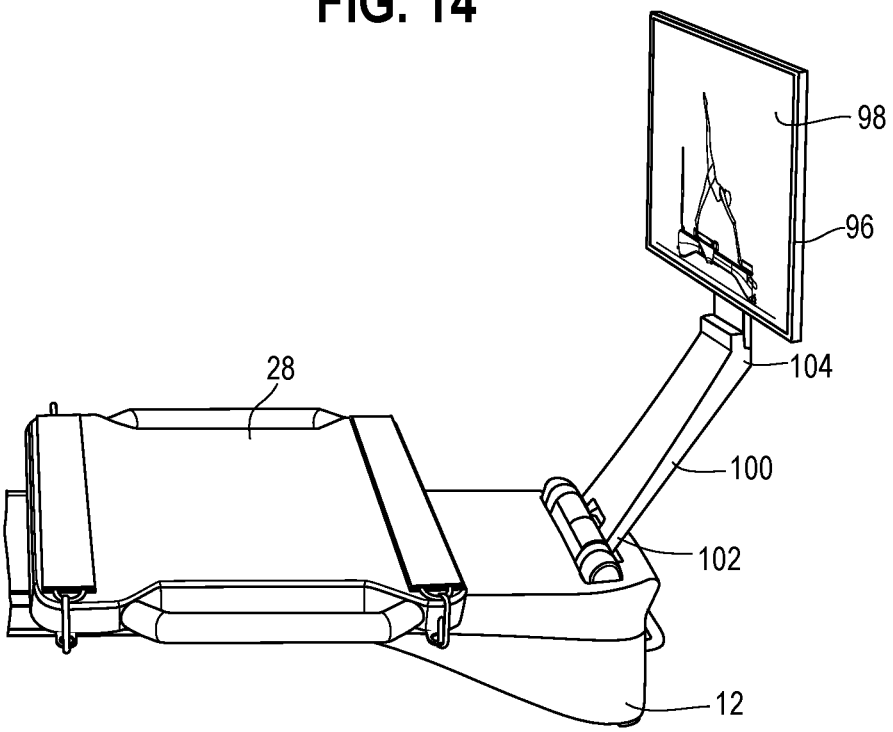
Figure 15:
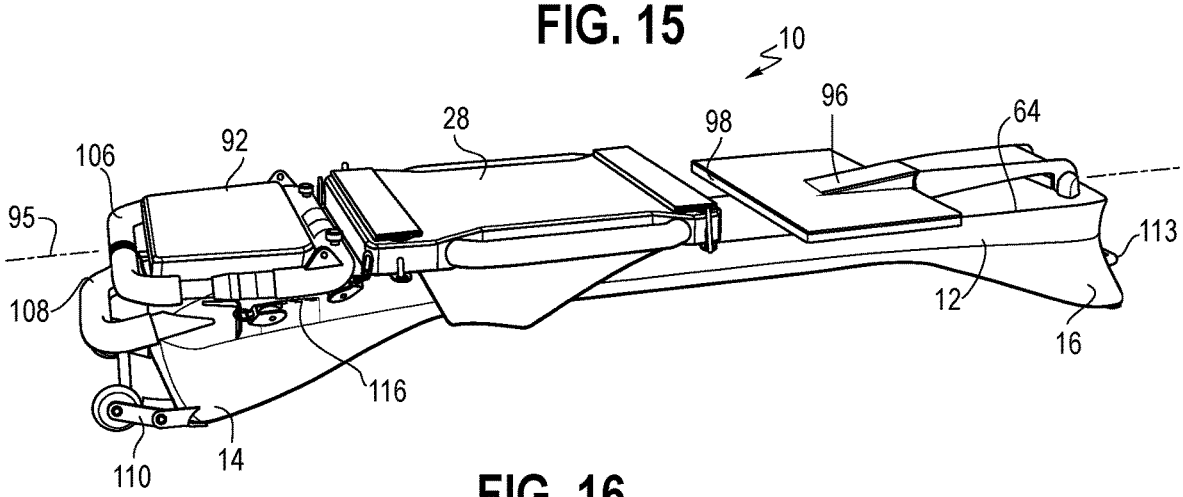
FIG. 15 is another perspective view of the pilates reformer of FIG. 1, showing the pilates reformer in a folded state.

For example. the screen assembly 96 may be configured such that the screen 98 can rotate left and right relative to the arm 100 (e.g., as shown in FIG. 13), and the screen 98 can move forward (e.g., 180 degrees forward from the upright position as shown in FIG. 14) and backward (e.g., 180 degrees backward from the upright position as shown in FIG. 14) relative to the arm 100. Advantageously, this configuration allows the user or other individuals to use the screen 98 to perform floor exercises adjacent to the reformer 10 (e.g., the screen 98 can be adjusted to provide courses to substantially the entire room, rather than the user at the reformer 10 only).

In some embodiments, when the carriage 28 is moved to the first end portion 20 of the frame 18, the screen assembly 96 can be folded down towards the first end portion 20 of the frame 18 to occupy at least part of a space occupied by the carriage 28 when the carriage 28 is moved toward the second end portion 22 of the frame 18, such that the reformer is in a folded state. For example, referring to FIGS. 15 and 16, the screen assembly 96 is configured to be laid generally parallel to the base 12 (e.g., laid generally flat on the upper surface 64 of the base 12), which is advantageous for facilitating transport and/or storage of the reformer 10, as discussed in greater detail below.

Figure 16:
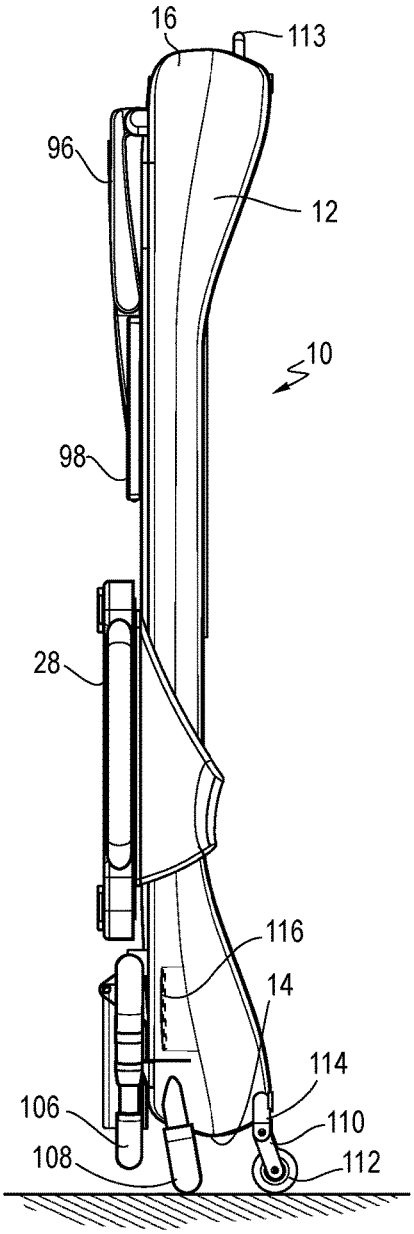
FIG. 16 is another perspective view of the pilates reformer of FIG. 15, showing the folded pilates reformer in a substantially upright position.
Figure 17:
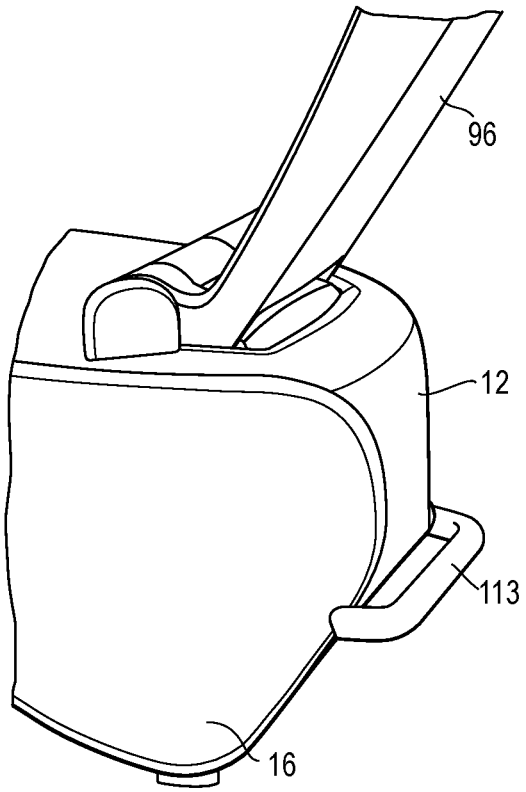
FIG. 17 is an enlarged perspective view of a portion of the pilates reformer of FIG. 1, showing a handle disposed on one end of the pilates reformer.

Referring to FIGS. 1, 5, 15, and 16, in some embodiments, the reformer 10 includes a pair of bars 106 pivotally coupled to the first end portion 20 of the frame 18. The pair of bars 106 is configured to extend outwardly from the upper surface 64 of the base 12 at varying angles (e.g., as shown in FIG. 1) or be laid generally parallel to the base 12 (e.g., laid generally flat on at least a portion of the base 12 (e.g., as shown in FIGS. 5, 15, and 16)).

With the configuration of the screen assembly 96 and the pair of bars 106, the reformer 10 is configured to transition between an unfolded state (e.g., as shown in FIGS. 1 and 23) and a folded state (e.g., when the screen assembly 96 and/or the pair of bars 106 are laid generally parallel to the base 12/frame 18 (e.g., laid generally flat on at least a portion of the base 12/frame 18), as shown in FIGS. 15 and 16). As shown in FIGS. 1 and 15, the length of the base 12 does not change when the reformer 10 is folded. That is, the frame 18 extends along a same length between the first end portion 20 of the frame 18 and the second end portion 22 of the frame 18 in both the unfolded state and the folded state of the reformer 10.

Figure 24:
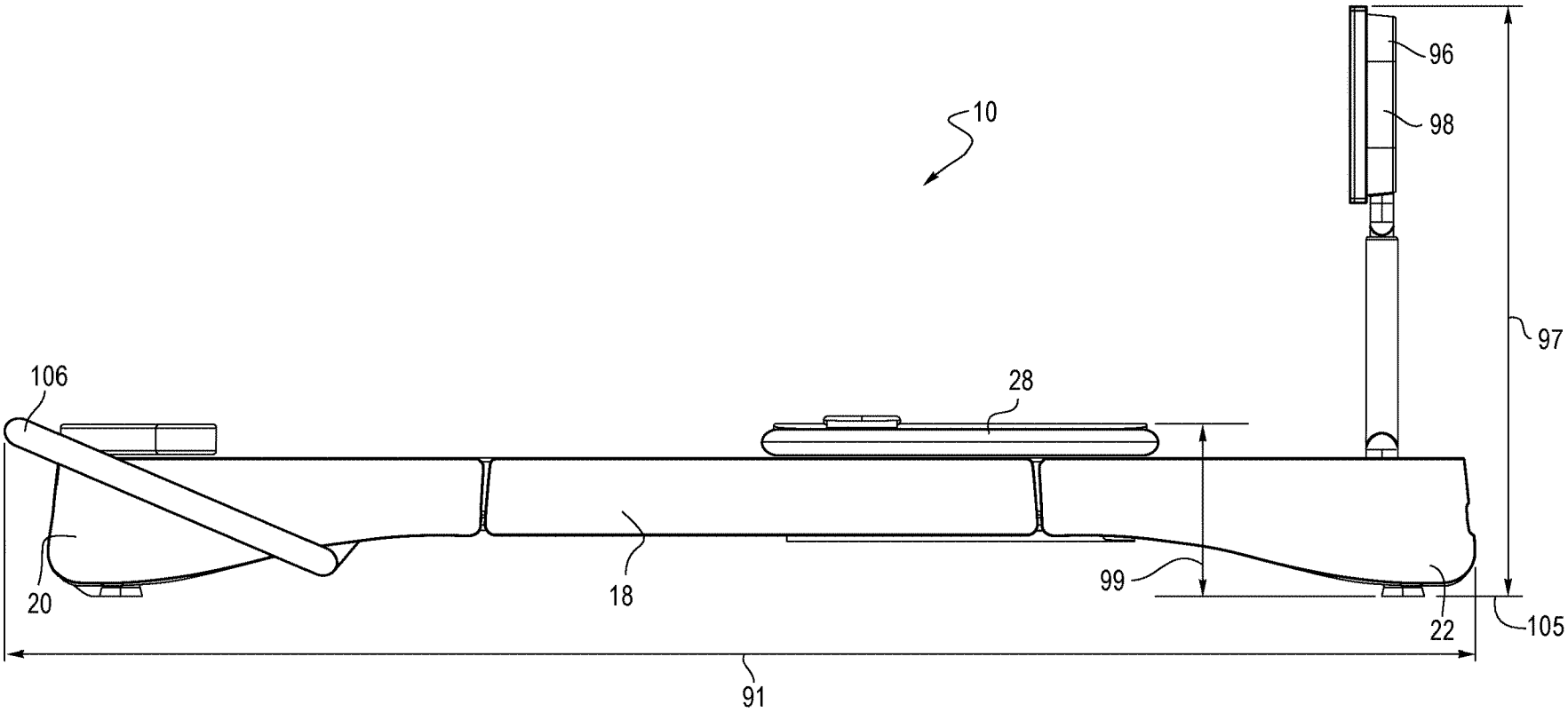
FIG. 24 is a side view of the reformer of FIG. 23.

In some embodiments, in both the unfolded state (e.g., in a substantially horizontal position) and the folded state (e.g., in a substantially upright position) of the reformer 10, the length 91 (e.g., as shown in FIG. 24) of the reformer 10 is less than 100 inches, preferably, the length 91 of the reformer 10 is less than 90 inches, and more preferably, the length 91 of the reformer 10 is less than 85 inches. As illustrated in FIG. 24, the length 91 is a distance between the two ends of the reformer 10 along the longitudinal axis 95 (shown in FIG. 23). In some embodiments, the bar 106 may be optional, but when the bar 106 is included, the bar 106 may extend beyond the first end portion 20 of the frame 18, such that the length 91 of the reformer 10 may be greater than the distance between the first end portion 20 and the second end portion 22 of the frame 18. This provides a balance between a sufficiently long frame (permitting a range of movement for the carriage and/or for different sized users), yet a relatively short length (permitting convenient storage under furniture and/or in an upright position (for example, in the corner of a room, or in a closet).

In some embodiments, in both the unfolded state and the folded state of the reformer 10, the width 93 (e.g., as shown in FIG. 28) of the reformer 10 is less than 30 inches, preferably, the width 93 of the reformer 10 is less than 25 inches, and more preferably, the width 93 of the reformer 10 is less than 20 inches (permitting convenient storage under furniture or in a closet). As illustrated in FIG. 28, the width 93 of the reformer 10 is a distance between the two sides of the carriage 28 in the Y direction (shown in FIG. 23).

In some embodiments, in the unfolded state of the reformer 10, the height 97 (e.g., as shown in FIG. 24) of the reformer 10 is less than 40 inches, preferably, the height 97 of the reformer 10 is less than 35 inches, and more preferably, the height 97 of the reformer 10 is less than 30 inches (providing a sufficiently high screen to permit visibility from multiple perspectives and/or for different sized users, while also providing foldability). As illustrated in FIG. 24, the height 97 of the reformer 10 in the unfolded state is a distance between a top surface of the screen 98 and a surface 105 on which the reformer 10 is disposed. In some embodiments, in the folded state of the reformer 10, the height 99 (e.g., as shown in FIG. 24) of the reformer 10 is less than 15 inches, preferably, the height 99 of the reformer 10 is less than 13 inches, and more preferably, the height 99 of the reformer 10 is less than 11 inches. As illustrated in FIG. 24, the height 99 of the reformer 10 in the folded state is a distance between a top surface of the carriage 28 and a surface 105 on which the reformer 10 is disposed. The dimensions of the reformer in the folded state (e.g., the length and the height) is advantageous for at-home use, as it allows the reformer 10 to be stored in a substantially horizontal orientation under a bed or another piece of furniture, or to be stored in a substantially vertical/upright orientation in a closet or somewhere else in the room, without occupying a significant amount of space.

Figure 18:
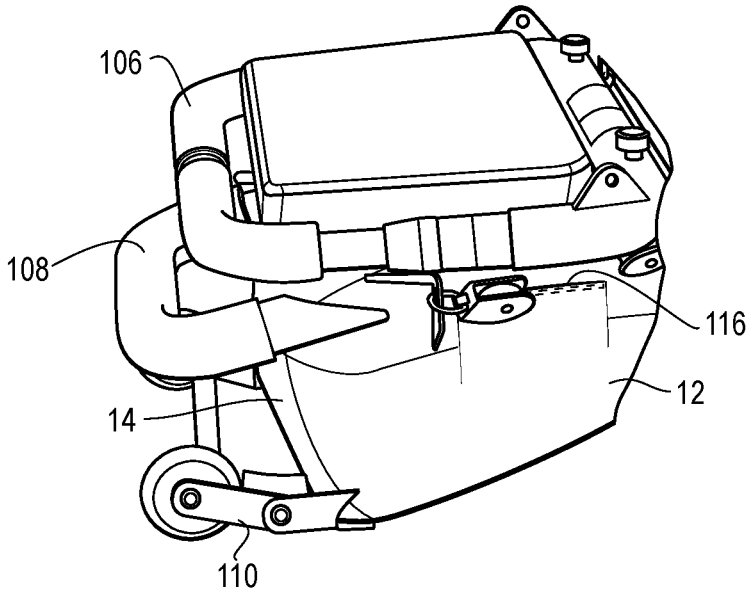
FIG. 18 is another enlarged perspective view of a portion of the pilates reformer of FIG. 1, showing another handle and wheels disposed on the other end of the pilates reformer.
Figure 21:
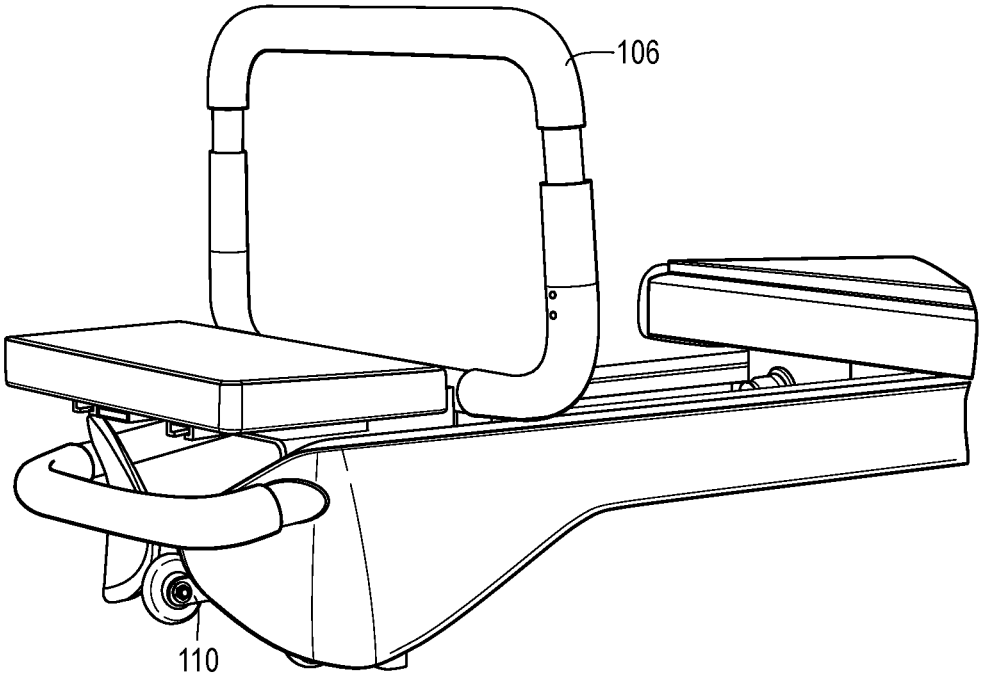
FIG. 21 is a perspective view of a portion of another embodiment of a pilates reformer, including a continuous bar and a wheel assembly.

In some embodiments, as shown in FIGS. 15, 16, and 18, the first end 14 of the base 12 includes a support mechanism 108 (e.g., a handle) and a wheel assembly/moving component 110. The support mechanism 108 extends outwardly from the first end 14 of the base 12. The wheel assembly 110 includes at least one wheel 112 pivotably connected to at least one wheel bar 114 extending outwardly from the first end 14 of the base 12. The wheel assembly 110 is configured to transition between a first state (e.g., as shown in FIGS. 15 and 18) which allows the reformer 10 to be placed on a substantially planar surface and a second state (e.g., as shown in FIG. 16). The support mechanism 108 and the wheel assembly 110 are configured such that when the wheel assembly 110 is in the second state, the support mechanism 108 and the wheel assembly 110 allow the reformer 10 to stand in a substantially upright position, which is advantageous for facilitating transport and/or storage. In some embodiments, the wheel assembly 110 may at least partially or entirely extend within the outer surface of the base 12 (e.g., at least partially covered by the base 12; as shown in FIG. 21), such that the wheel assembly 110 is at least partially or entirely hidden, which is advantageous for preventing users from accidentally stepping on the wheel assembly 110.

In some embodiments, as shown in FIGS. 15-17, 23, and 26, a handle 113 is provided at the second end 16 of the base 12 (or at the second end portion 22 of the frame 18, as shown in FIG. 23), which may be used to move the reformer 10 when the reformer is in the folded state or in the unfolded state. Referring to FIG. 23, the handle 113 is configured to allow the second end portion 22 of the frame 18 to be lifted away from a surface 105 (e.g., as shown in FIG. 27) on which the reformer 10 is disposed, and rotated about the first end portion 20 of the frame 18 that is still on the surface. In some embodiments, the pair of bars 106 may be replaced with a continuous bar 106 formed as one unit (e.g., not separated as two bars; as shown in FIGS. 21 and 23), without departing from the scope of the present invention.

Referring to FIG. 23, in some embodiments, the bar 106 is disposed at and pivotably coupled to the first end portion 20 of the frame 18. The bar 106 is configured to move between a first position (e.g., as shown in FIGS. 23-25 and 27) and a second position. When the bar 106 is in the first position, the bar 106 allows the reformer 10 to be placed on a surface 105 (e.g., where the reformer 10 is in a substantially horizontal position with respect to the surface 105), and at least a portion of the bar 106 is above the frame 18, which allows a user of the reformer 10 to use/grip the bar 106. The bar 106 is configured such that a user can rotate the bar 106 downward into a position (e.g., the second position) below the upper surface of the frame 18. When the bar 106 is in the second position, it can provide support to the frame 18 such that the frame 18 can stand in a substantially upright position, where the longitudinal axis 95 of the frame 18 is substantially perpendicular to the surface 105.

Figure 25:
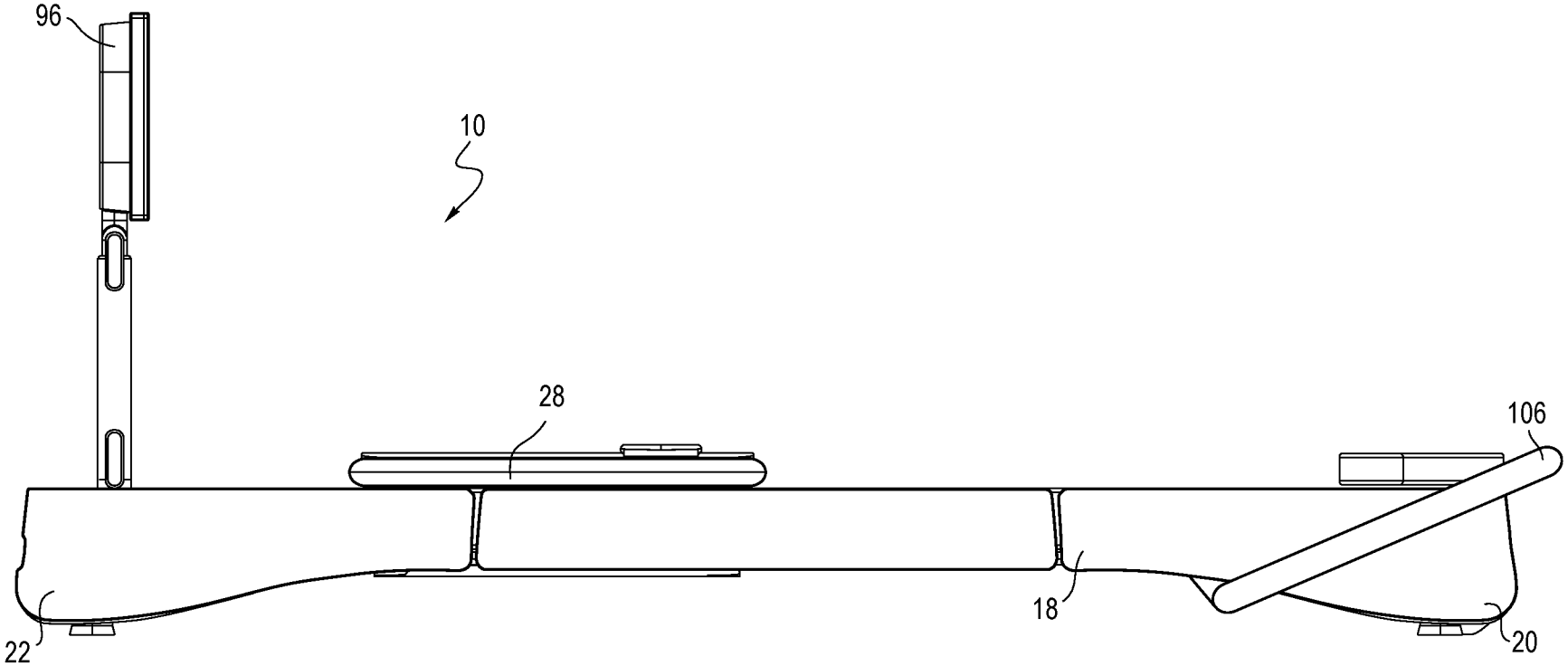
FIG. 25 is another side view of the reformer of FIG. 23.

Accordingly, the reformer 10 is configured to transition between a substantially horizontal position with respect to the surface 105 (e.g., as shown in FIGS. 24 and 25, when the bar 106 is in the first position) and a substantially upright position with respect to the surface 105 (e.g., when the bar 106 is in the second position). This is advantageous for at-home use, as it allows the reformer 10 to be stored in a substantially horizontal orientation under a bed or another piece of furniture, or to be stored in a substantially vertical/upright orientation in a closet or somewhere else in a room, without occupying too much space.

Figure 26:
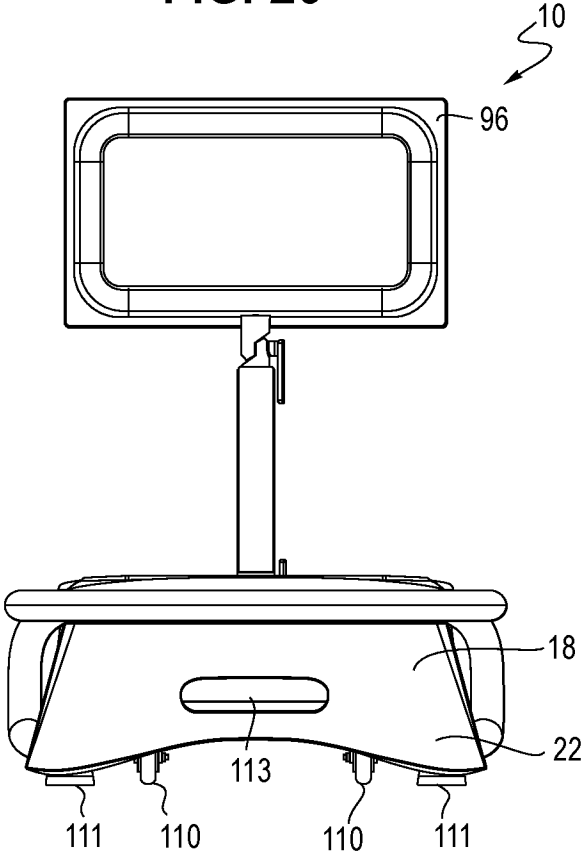
FIG. 26 is a front view of the reformer of FIG. 23.

As shown in FIGS. 26 and 27, a moving component 110 (e.g., wheel(s)) is disposed at the first end portion 20 of the frame 18, where the moving component 110 is configured to allow movement of the frame 18 when the second end portion 22 of the frame 18 is lifted away from the surface 105. When the bar 106 is in the second position, it may contact the surface 105 when a user lifts the second end portion 22 of the frame 18 away from the surface 105, thereby protecting the first end portion 20 of the frame 18 during movement of the reformer 10 (e.g., by preventing the first end portion 20 of the frame 18 from contacting the surface 105). In some embodiments, as shown in FIGS. 26 and 27, a support structure 111 (e.g., grip or foot) may be disposed at the first end portion 20 of the frame 18 and the second end portion 22 of the frame 18, respectively, for supporting the reformer 10 in the substantially horizontal position with respect to the surface 105.

In some embodiments of the reformers disclosed herein, one or more sensors may be provided for purposes of providing usage data, analysis, and/or feedback to a user of the reformer, during use. For example, one or more position sensors may be provided on the rail, the slidable carriage, the extendible platform, the handles fixed to the reformer, the optional straps, pulleys, and handles, and/or the screen, and arm supporting the screen. As another example, one or more position sensors may be worn by a user of the reformer, for example, in toe socks, grip gloves, or other articles of clothing. As a further example, one or more force sensors and/or force transducers, or tension sensors, may be provided for each of the plurality of springs mounted on the carriage.

Suitable position sensors include capacitive displacement sensors, Eddy-current sensors, Hall effect sensors, inductive sensors, laser Doppler vibrometer (optical) sensors, linear variable differential transformer (LVDT) sensors, photodiode array sensors, piezo-electric transducer sensors, ultrasound, RFID, etc. Suitable forces sensors include load cells, strain gages, force sensing resistors, etc.

It is envisioned that data collected from one or more of the above sensors may be communicated (wired or wireless) to a processing unit (whether associated with the reformer, or remotely), and used to provide real-time and/or post-usage data, analysis, and/or feedback, for example, on the screen of the reformer. Such data, analysis, and/or feedback may include, but is not limited to, "pose tracking" (i.e., the ability to achieve and/or maintain specific poses, or pilates maneuvers), usage time, carriage speed, strap or pulley speed, spring tension levels, etc.

In some embodiments of the reformers disclosed herein, a camera may be provided, in addition to, or as an alternative to, the one or more sensors described above, for capturing images and/or video of a user of the reformer. The images and/or video may be used for providing analysis and/or feedback to a user of the reformer, whether in real-time, or post-usage, for example, on the screen of the reformer. In some embodiments, a trained pilates instructor in a remote location may provide the analysis and/or feedback to a user of the reformer, for example, on the screen of the reformer. In other embodiments, position sensors in or associated with the camera may be used to provide the analysis and/or feedback to a user of the reformer.

Although the subject matter has been described in language specific to structural features and/or methodological acts, it is to be understood that the subject matter defined in the appended claims is not necessarily limited to the specific features or acts described. Rather, the specific features and acts are disclosed as illustrative forms of implementing the claims.

One skilled in the art will realize that a virtually unlimited number of variations to the above descriptions are possible, and that the examples and the accompanying figures are merely to illustrate one or more examples of implementations.

It will be understood by those skilled in the art that various other modifications can be made, and equivalents can be substituted, without departing from claimed subject matter. Additionally, many modifications can be made to adapt a particular situation to the teachings of claimed subject matter without departing from the central concept described herein. Therefore, it is intended that claimed subject matter not be limited to the particular embodiments disclosed, but that such claimed subject matter can also include all embodiments falling within the scope of the appended claims, and equivalents thereof.

In the description above, specific details are set forth to provide an understanding of claimed subject matter. However, it will be understood by those skilled in the art that claimed subject matter can be practiced without these specific details. In other instances, methods, devices, or systems that would be known by one of ordinary skill have not been described in detail so as not to obscure claimed subject matter.

Reference throughout this specification to "one embodiment," "an embodiment," "some embodiments," "other embodiments," "one aspect," or "an aspect" can mean that a particular feature, structure, or characteristic described in connection with a particular embodiment can be included in at least one embodiment of claimed subject matter. Thus, appearances of the phrase "in one embodiment," "an embodiment," "some embodiments," "other embodiments," "in on aspect," or "an aspect," in various places throughout this specification are not necessarily intended to refer to the same embodiment(s) or to any one particular embodiment described. Furthermore, it is to be understood that particular features, structures, or characteristics described can be combined in various ways in one or more embodiments. In general, of course, these and other issues can vary with the particular context of usage. Therefore, the particular context of the description or the usage of these terms can provide helpful guidance regarding inferences to be drawn for that context.

We claim:

1. A reformer, comprising:

a frame extending between two end portions;

a carriage slidably supported by the frame;

a screen assembly rotatably coupled to the frame, wherein the screen assembly is configured to be rotatable between a first position, generally perpendicular to a longitudinal axis of the frame, and a second position, generally parallel to the longitudinal axis of the frame;

a handle disposed at one end portion of the frame, wherein the handle and the screen assembly are disposed at opposite end portions of the frame; and a moving component, wherein the moving component and the handle are disposed at opposite end portions of the frame, wherein the screen assembly includes a screen and an arm, wherein the screen is configured to rotate or pivot about a first axis extending generally perpendicular to the longitudinal axis of the frame in a Z direction, and wherein the screen is configured to rotate or pivot about a second axis extending generally perpendicular to the longitudinal axis of the frame in a Y direction.

2. The reformer of claim 1, wherein the handle is configured to allow the one end portion of the frame to be lifted away from a surface on which the reformer is disposed, and to rotate the frame about the other end portion of the two end portions of the frame.

3. The reformer of claim 2, wherein the moving component is configured to allow movement of the frame when the one end portion of the frame is lifted away from the surface.

4. The reformer of claim 2, wherein the reformer is configured to transition between a substantially horizontal position with respect to the surface and a substantially upright position with respect to the surface, wherein when the reformer is in the substantially horizontal position and the screen assembly is in the second position, the length of the reformer is less than 100 inches and the height of the reformer is less than 15 inches, and wherein when the reformer is in the substantially upright position, the length and the height of the reformer remain the same as in the substantially horizontal position.

5. The reformer of claim 1, further comprising a platform, wherein the platform and the screen assembly are disposed at opposite end portions of the frame.

6. The reformer of claim 1, wherein the reformer is configured to transition between an unfolded state and a folded state, and wherein the length of the frame remains the same when the reformer is folded or unfolded.

7. The reformer of claim 6, wherein the length of the reformer is less than 100 inches.

8. The reformer of claim 6, wherein when the reformer is in the folded state, the height of the reformer is less than 15 inches.

9. The reformer of claim 1, wherein the arm is configured to rotate or pivot about the first axis extending generally perpendicular to the longitudinal axis of the frame in a Z direction, and wherein the arm is configured to rotate or pivot about the second axis extending generally perpendicular to the longitudinal axis of the frame in a Y direction.

10. The reformer of claim 1, wherein the screen is rotatable or pivotable about the first axis in the Z direction, such that the screen can be seen by a user at a position adjacent the reformer for performing exercises adjacent the reformer.

11. A reformer, comprising:

a frame extending between a first end portion and a second end portion; and a carriage slidably coupled to the frame, wherein the carriage is movable along a length of the frame, the carriage including a tension member mounted to and moveable with the carriage, wherein the carriage is configured to be selectively and releasably coupled to the first end portion of the frame via a first end of the tension member, and selectively and releasably coupled to the second end portion of the frame via a second end of the tension member, wherein a first connector is coupled to the first end of the tension member and configured to be releasably coupled to the first end portion of the frame, wherein the first end portion of the frame includes a first actuation mechanism and a first connection mechanism, wherein the first connection mechanism is configured to selectively and releasably engage the first connector, and wherein the first actuation mechanism is configured to be pushed downward to engage the first connector.

12. The reformer of claim 11, further comprising a platform and a screen assembly, wherein the platform and the screen assembly are disposed at opposite end portions of the frame.

13. The reformer of claim 11, wherein the carriage includes a plurality of tension members, and wherein each tension member of the plurality of tension members offers a different level of resistance to movement of the carriage.

14. The reformer of claim 13, wherein the first end portion of the frame includes a plurality of first actuation mechanisms and a plurality of first connection mechanisms, wherein each first connection mechanism of the plurality of first connection mechanisms is configured to selectively and releasably engage a first end of a tension member of the plurality of tension members, wherein the second end portion of the frame includes a plurality of second actuation mechanisms and a plurality of second connection mechanisms, and wherein each second connection mechanism of the plurality of second connection mechanisms is configured to selectively and releasably engage a second end of a tension member of the plurality of tension members.

15. The reformer of claim 14, wherein the plurality of first actuation mechanisms are configured to allow a user to select varying levels of resistance to the movement of the carriage without manually moving the first or the second ends of the plurality of tension members.

16. The reformer of claim 11, wherein the first actuation mechanism is configured to be pushed downward to disengage the first connector.

17. The reformer of claim 11, wherein the tension member is disposed entirely underneath the carriage.

18. The reformer of claim 17, wherein the tension member is fully enclosed inside an enclosure underneath the carriage.

19. The reformer of claim 18, wherein when the tension member is not coupled to either one of the first and second end portions of the frame, the tension member remains in the enclosure as the carriage moves on the reformer, and wherein when the tension member is coupled to one of the first and second end portions of the frame, at least a portion of the tension member remains in the enclosure when the carriage moves towards the other one of the first and second end portions of the frame.

20. The reformer of claim 11, wherein the first connection mechanism, the first actuation mechanism, and the first connector are configured such that when the first actuation mechanism is in a first state, the first connector is received in the first connection mechanism and coupled to the first end portion of the frame, and when the first actuation mechanism is in a second state, the first connector is decoupled from the first end portion of the frame.

* * * * *